US011024236B2

(12) United States Patent
Furihata et al.

(10) Patent No.: US 11,024,236 B2
(45) Date of Patent: Jun. 1, 2021

(54) DISPLAY DRIVER WITH GAMMA CORRECTION

(71) Applicant: Synaptics Japan GK, Tokyo (JP)

(72) Inventors: Hirobumi Furihata, Tokyo (JP); Kazutoshi Aogaki, Tokyo (JP); Takashi Nose, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 277 days.

(21) Appl. No.: 15/868,307

(22) Filed: Jan. 11, 2018

(65) Prior Publication Data

US 2018/0204522 A1 Jul. 19, 2018

(30) Foreign Application Priority Data

Jan. 13, 2017 (JP) ..... JP2017-004518

(51) Int. Cl.
*G09G 5/10* (2006.01)
*G09G 3/3275* (2016.01)

(52) U.S. Cl.
CPC ... *G09G 3/3275* (2013.01); *G09G 2300/0452* (2013.01); *G09G 2310/027* (2013.01); *G09G 2320/0276* (2013.01); *G09G 2320/0626* (2013.01); *G09G 2320/0673* (2013.01)

(58) Field of Classification Search
CPC ..... G09G 5/10; G09G 5/02; G09G 5/026; G09G 3/32; G09G 5/36
See application file for complete search history.

(56) References Cited

U.S. PATENT DOCUMENTS 5,473,372 A 12/1995 Nobuoka et al.
6,559,826 B1 * 5/2003 Mendelson ..... G09G 3/2092 345/102
8,855,375 B2 * 10/2014 Macciola ..... G06T 7/194 382/112
9,230,509 B2 * 1/2016 Van Der Vleuten .... G06T 5/002
10,750,173 B2 * 8/2020 Stessen ..... H04N 19/12
2005/0231457 A1 * 10/2005 Yamamoto ..... G09G 3/3413 345/102
2007/0013979 A1 * 1/2007 Nose ..... G09G 3/3685 358/519
2007/0222728 A1 * 9/2007 Koyama ..... G09G 5/02 345/87
2007/0268524 A1 11/2007 Nose et al.
2008/0238840 A1 * 10/2008 Raman ..... G09G 3/3413 345/84
2008/0259099 A1 * 10/2008 Arai ..... G09G 3/2003 345/690

(Continued)

FOREIGN PATENT DOCUMENTS

JP H04288781 A 10/1992
JP 2007310097 A 11/2007

(Continued)

*Primary Examiner* — Olga V Merkoulova
(74) *Attorney, Agent, or Firm* — Ferguson Braswell Fraser Kubasta PC

(57) ABSTRACT

A system and method for controlling the screen brightness of a display comprising calculating a brightness data which specifies a screen brightness level of a self-luminous display panel, determining, based on the brightness data, correction control points, calculating an output value from the input grayscale value with input-output characteristics specified by the correction control points.

20 Claims, 18 Drawing Sheets

(56) References Cited

U.S. PATENT DOCUMENTS

| | | | | |
|---|---|---|---|---|
| 2011/0122171 | A1* | 5/2011 | Kwon | G09G 3/342<br>345/690 |
| 2011/0148942 | A1* | 6/2011 | Furihata | G09G 5/003<br>345/690 |
| 2011/0242140 | A1* | 10/2011 | Lee | G09G 3/3648<br>345/690 |
| 2014/0340435 | A1* | 11/2014 | Ozawa | G09G 3/3233<br>345/690 |
| 2014/0375704 | A1* | 12/2014 | Bi | G09G 3/3233<br>345/694 |
| 2015/0221280 | A1* | 8/2015 | Van Der Vleuten | G06T 5/002<br>382/167 |
| 2017/0358115 | A1* | 12/2017 | Kaida | G06T 3/0068 |
| 2018/0204522 | A1* | 7/2018 | Furihata | G09G 3/3275 |
| 2019/0130872 | A1* | 5/2019 | Furihata | G09G 5/10 |

FOREIGN PATENT DOCUMENTS

| | | | |
|---|---|---|---|
| JP | 2011133578 | A | 7/2011 |
| JP | 2015529890 | A | 10/2015 |

* cited by examiner $AX_0 = X_{CP}(2k)'$
$AX_0 = X_{CP}(2k+1)'$
$AX_0 = X_{CP}(2k+2)'$
$YX_0 = Y_{CP}(2k)'$
$BY_0 = Y_{CP}(2k+1)'$
$CY_0 = Y_{CP}(2k+2)'$

DISPLAY DRIVER WITH GAMMA CORRECTION

CROSS REFERENCE

This application claims priority of Japanese Patent Application No. 2017-004518, filed on Jan. 13, 2017, the disclosure of which is incorporated herein by reference.

TECHNICAL FIELD

The present disclosure relates to a display driver, a display device and a driving method, more particularly, to image data processing adapted to drive a self-luminous display panel such as OLED (organic light emitting diode) display panels.

BACKGROUND ART

In many common implementations, a display driver driving a display panel is configured to perform gamma correction matching the characteristics of the display panel. The gamma correction may include image data processing performed to correctly display an image with brightness levels corresponding to the grayscale values specified by image data. Generally, the correspondence relation between the brightness levels of subpixels (R subpixels, G subpixels and B subpixels) and the signal levels of drive signals (drive voltages or drive currents) is not linear in the display panel. For example, the voltage-transparency curve (V-T curve) of a liquid crystal display panel may not be linear. Accordingly, in various implementations, supplying drive signals proportional to the grayscale values specified by display data does not achieve displaying an image with correct brightness levels.

However, gamma correction may be performed to display an image on such a display panel with the brightness levels corresponding to the specified grayscale values.

Additionally, in various implementations, a display driver which drives a self-luminous display panel such as OLED (organic light emitting diode) display panels is adapted to perform image data processing for controlling the screen brightness level in concurrence with gamma correction. In general, a display device has the function of adjusting the screen brightness level (that is, the brightness level of the entire displayed image). This function allows the display device to increase the screen brightness level through a manual operation, when a user desires to display a brighter image, for example.

For a display device including a backlight, such as liquid crystal display panels, in various implementations, it is not necessary to perform image data processing for controlling the screen brightness level, because the screen brightness level can be adjusted by the brightness of the backlight. In driving a self-luminous display panel such as OLED display panels, in contrast, the signal levels of the drive signals supplied to the respective subpixels of the respective pixels are controlled to control the screen brightness level. Accordingly, image data processing may be performed on image data to control the screen brightness level in driving a self-luminous display panel.

In one or more implementations, a display driver driving a self-luminous display panel may include a gamma correction circuitry which performs processing for controlling the screen brightness level in concurrence with gamma correction. Such gamma correction circuitry may however may increase the circuit size and/or decrease in the number of representable grayscale levels.

SUMMARY

In one embodiment, a display driver includes: a correction circuitry configured to calculate an output value from an input grayscale value and a brightness data which specifies a screen brightness level of a self-luminous display panel; and a drive circuitry configured to generate a drive signal driving a light-emitting element of the self-luminous display panel in response to the output value. The correction circuitry is configured to determine, based on the brightness data, correction control points used for correction performed on the input grayscale value for the screen brightness level specified by the brightness data, and calculate the output value from the input grayscale value with input-output characteristics specified by the correction control points.

In another embodiment, a display device includes a self-luminous display panel in which each pixel circuit includes a light-emitting element; and a display driver driving the self-luminous display panel. The display driver includes: a correction circuitry configured to calculate an output value from an input grayscale value and a brightness data which specifies a screen brightness level of the self-luminous display panel; and a drive circuitry configured to generate a drive signal driving the light-emitting element of the self-luminous display panel in response to the output value. The correction circuitry is configured to determine, based on the brightness data, correction control points used for correction performed on the input grayscale value for the screen brightness level specified by the brightness data, and calculate the output value from the input grayscale value with input-output characteristics specified by the correction control points.

In still another embodiment, a method includes: calculating an output value from an input grayscale value and a brightness data which specifies a screen brightness level of a self-luminous display panel in which each pixel circuit includes a light-emitting element; and generating a drive signal driving the light-emitting element of the self-luminous display panel in response to the output value. The step of calculating the output value includes: determining, based on the brightness data, correction control points used for correction performed on the input grayscale value for the screen brightness level specified by the brightness data; and calculating the output value from the input grayscale value with input-output characteristics specified by the correction control points.

DETAILED DESCRIPTION

In the following, a description is given of various embodiments.

In one embodiment, a display driver configured for driving a self-luminous display drive is adapted to perform image data processing for controlling the screen brightness level in concurrence with gamma correction. A self-luminous display panel referred herein includes a display panel in which a pixel circuit constituting a subpixel of each pixel includes a light emitting element, such as OLED display panel. In one embodiment of an OLED display panel, each pixel includes a red subpixel, a green subpixel and a blue subpixel which include light emitting elements emitting red light, green light and blue light, respectively. In other embodiments, each pixel may include other subpixel colors in addition to red, green and blue subpixels. For example, pixels may additionally include white subpixels. Further, in yet other embodiments, each pixel may include other subpixel colors alternatively to red, green, and/or blue subpixels.

Figure 1:
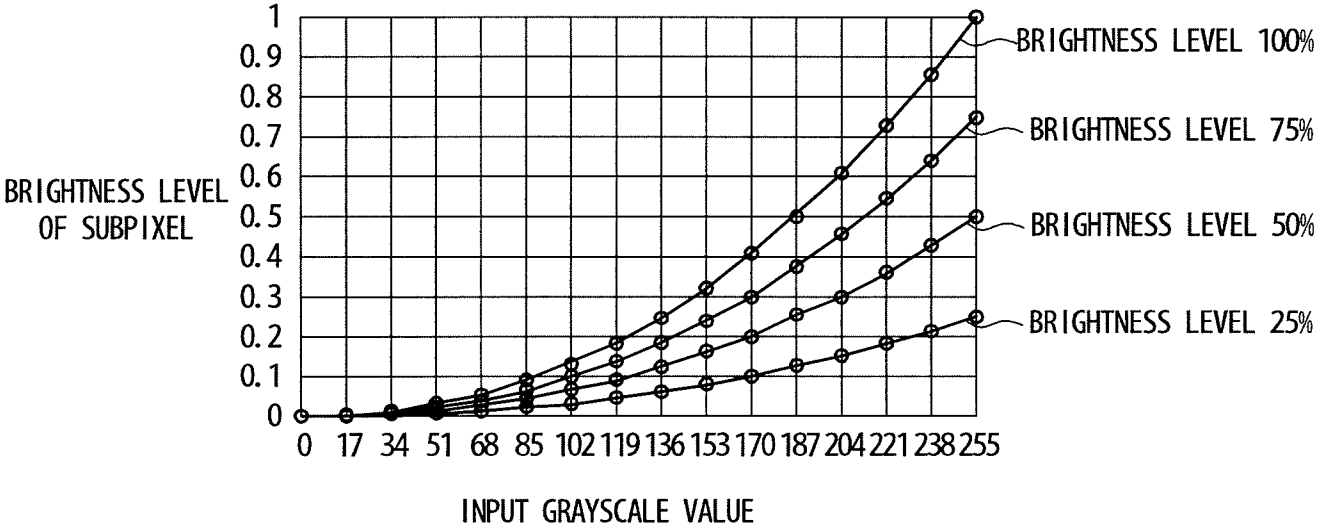
FIG. 1 is a graph illustrating the corresponding brightness levels to be achieved through gamma correction according to one or more embodiments.

FIG. 1 illustrates one embodiment of the correspondence relation between the input grayscale value and the brightness levels of each subpixel to be achieved by ideal gamma characteristics of a display panel, for each screen brightness level. The legend "brightness level 100%" indicates a graph illustrating the gamma characteristics for the case where the screen brightness level is the allowed maximum brightness level (100%), and the legend "brightness level 75%" indicates a graph illustrating the gamma characteristics for the case where the screen brightness level is 75% of the allowed maximum brightness level. Similarly, the legend "brightness level 50%" indicates a graph illustrating the gamma characteristics for the case where the screen brightness level is 50% of the allowed maximum brightness level and the legend "brightness level 25%" indicates a graph illustrating the gamma characteristics for the case where the screen brightness level is 25% of the allowed maximum brightness level.

In FIG. 1, the graphs are normalized based on the brightness level of a subpixel being 1.0 when the input grayscale value associated with the subpixel is the allowed maximum value (255 in FIG. 1) for the case where the screen brightness level is the maximum brightness level (the brightness level of 100%). For the screen brightness level of 100%, for example, the ideal brightness level of a certain subpixel is 0.5 when the input grayscale value associated with this subpixel is 186.

Figure 2:
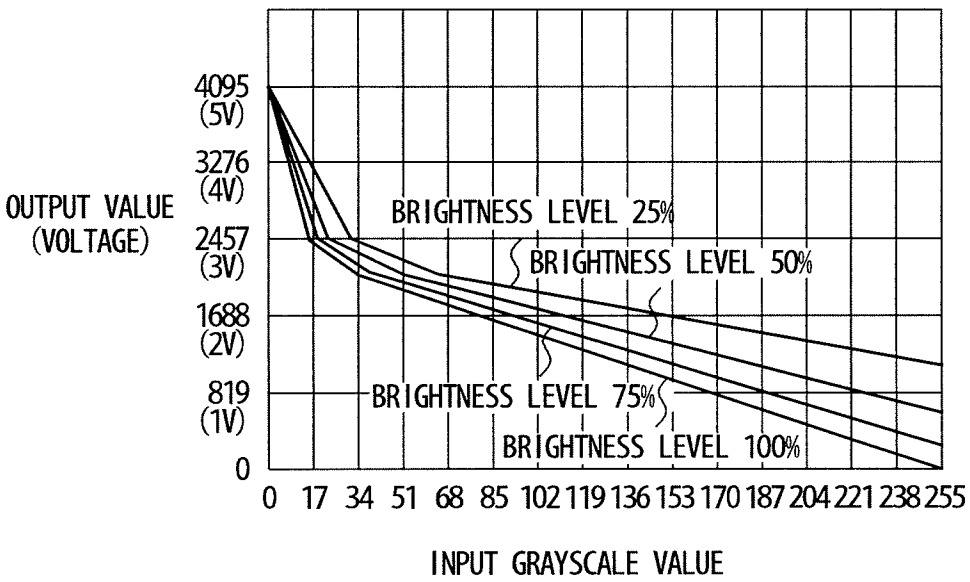
FIG. 2 is a graph illustrating input-output characteristics of gamma correction for screen brightness levels according to one or more embodiments.

In one embodiment, the input-output characteristics of the gamma correction are modified in response to the screen brightness level. Further, processing for controlling the screen brightness level may be performed in concurrence with gamma correction. FIG. 2 is a graph illustrating one example of ideal input-output characteristics of the gamma correction for each screen brightness level. Illustrated in FIG. 2 are the input-output characteristics of the gamma correction for each screen brightness level when display data used to drive an OLED display panel through voltage programming are generated. In FIG. 2, the graph of the input-output characteristics is drawn with an assumption that the value of the display data (that is, the output value of the gamma correction) is a 12-bit value and each subpixel of each pixel of the OLED display panel is programmed with a voltage proportional to the value of the display data. When the output value is "4095", for example, the subpixel of interest is programmed with a voltage of 5V. It should be noted that the brightness level of the subpixel is increased as the drive voltage is decreased, when an OLED display panel is driven through voltage programming.

With reference to FIG. 2, the shape of the input-output characteristics curve of the gamma correction depends on the screen brightness level due to the gamma characteristics of the display panel. For example, the input grayscale value at which the input-output characteristics curve is bent depends on the screen brightness level. More specifically, in the example illustrated in FIG. 2, the input-output characteristics curve is bent at input grayscale values of "17" and "34" for a screen brightness level of 100%, while the input-output characteristics curve is bent at input grayscale values of "30" and "66" for a screen brightness level of 25%.

The dependency of the input-output characteristics curve on the screen brightness level may cause a problem of an undesired increase in the circuit size of a gamma correction circuitry which performs processing for controlling the screen brightness level in concurrence with gamma correction. For example, a one approach to achieve processing for controlling the screen brightness level in concurrence with gamma correction is to prepare an LUT (lookup table) corresponding to the input-output characteristics for each screen brightness level. However, in various embodiments, preparing an LUT (lookup table) corresponding to the input-output characteristics for each screen brightness level may undesirably increase the circuit size of the gamma correction circuitry, because an LUT has a large circuit size.

Figure 3:
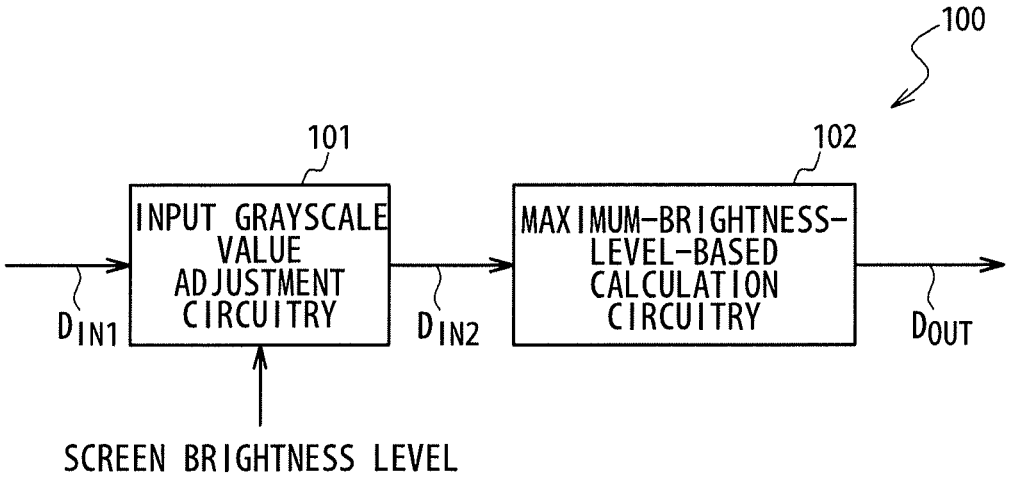
FIG. 3 is a block diagram of a gamma correction circuitry according to one or more embodiments.

One possible approach to avoid an increase in the circuit size of a gamma correction circuitry may be to provide a processing circuitry (such as an LUT) which achieves the input-output characteristics of gamma correction for the allowed maximum screen brightness level and to adjust the input grayscale value supplied to the processing circuitry in response to the screen brightness level. FIG. 3 is a block diagram illustrating the configuration of a gamma correction circuitry 100 thus configured. It should be noted that the Applicant does not acknowledge that the configuration of the gamma correction circuitry 100 illustrated in FIG. 3 is publically known in the art.

The gamma correction circuitry 100 illustrated in FIG. 3 includes an input grayscale value adjustment circuitry 101 and a maximum-brightness-level-based calculation circuitry 102. The input grayscale value adjustment circuitry 101 calculates an input grayscale value $D_{IN2}$ to be supplied to the maximum-brightness-level-based calculation circuitry 102 on the basis of the screen brightness level and an input grayscale value $D_{IN1}$ externally supplied to the gamma correction circuitry 100. The maximum-brightness-level-based calculation circuitry 102 provides the input-output characteristics of the gamma correction for the allowed screen maximum brightness level (a screen brightness level of 100%). In one embodiments, when receiving the input grayscale value $D_{IN2}$, the allowed maximum-brightness-level-based calculation circuitry 102 outputs an output value $D_{OUT}$ corresponding to the input grayscale value $D_{IN2}$ in accordance with the input-output characteristics of the gamma correction for the maximum screen brightness level (the screen brightness level of 100%). For example, the maximum-brightness-level-based calculation circuitry 102 may output the output value $D_{OUT}$ corresponding to the input grayscale value $D_{IN2}$ in accordance with the input-output relationship defined by the graph indicated by "brightness level 100%" in FIG. 2. Such operation can be achieved by using an LUT as the maximum-brightness-level-based calculation circuitry 102, for example.

When the gamma value of the gamma correction is γ and the screen brightness level is q times (where $0 \le q < 1$) of the allowed maximum brightness level, the following expression (1a) holds for the input grayscale value $D_{IN1}$ of the gamma correction circuitry 100 and the input grayscale value $D_{IN2}$ to be supplied to the maximum-brightness-level-based calculation circuitry 102:

$$D_{IN2}^{\gamma} = q \cdot D_{IN1}^{\gamma} \tag{1a}$$

The following expression (1b) can be obtained from expression (1a):

$$D_{IN2} = q^{1/\gamma} \cdot D_{IN1} \tag{1b}$$

In one embodiment, when the gamma value γ of the display panel is 2.2 and the screen brightness level is 0.5 times of the allowed maximum brightness level (a screen brightness level of 50%), for example, the following expression (1c) is obtained from expression (1b):

$$\begin{aligned} D_{IN2} &= 0.5^{\frac{1}{2.2}} \cdot D_{IN1} \\ &\approx \left(\frac{186}{255}\right) \cdot D_{IN1} \end{aligned} \tag{1c}$$

Expression (1c) implies that, for the gamma value γ of 2.2, the input-output characteristics of the gamma correction for a screen brightness level of 50% can be achieved by supplying the value obtained as (186/255) times of the input grayscale value $D_{IN1}$ to the maximum-brightness-level-based calculation circuitry 102. In various embodiments, when the gamma value is γ and the screen brightness level is q times of the allowed maximum brightness level, gamma correction for a screen brightness level of q times of the allowed maximum brightness level can be achieved by supplying the value obtained as $q^{1/\gamma}$ times of the input grayscale value $D_{IN1}$.

Figure 4:
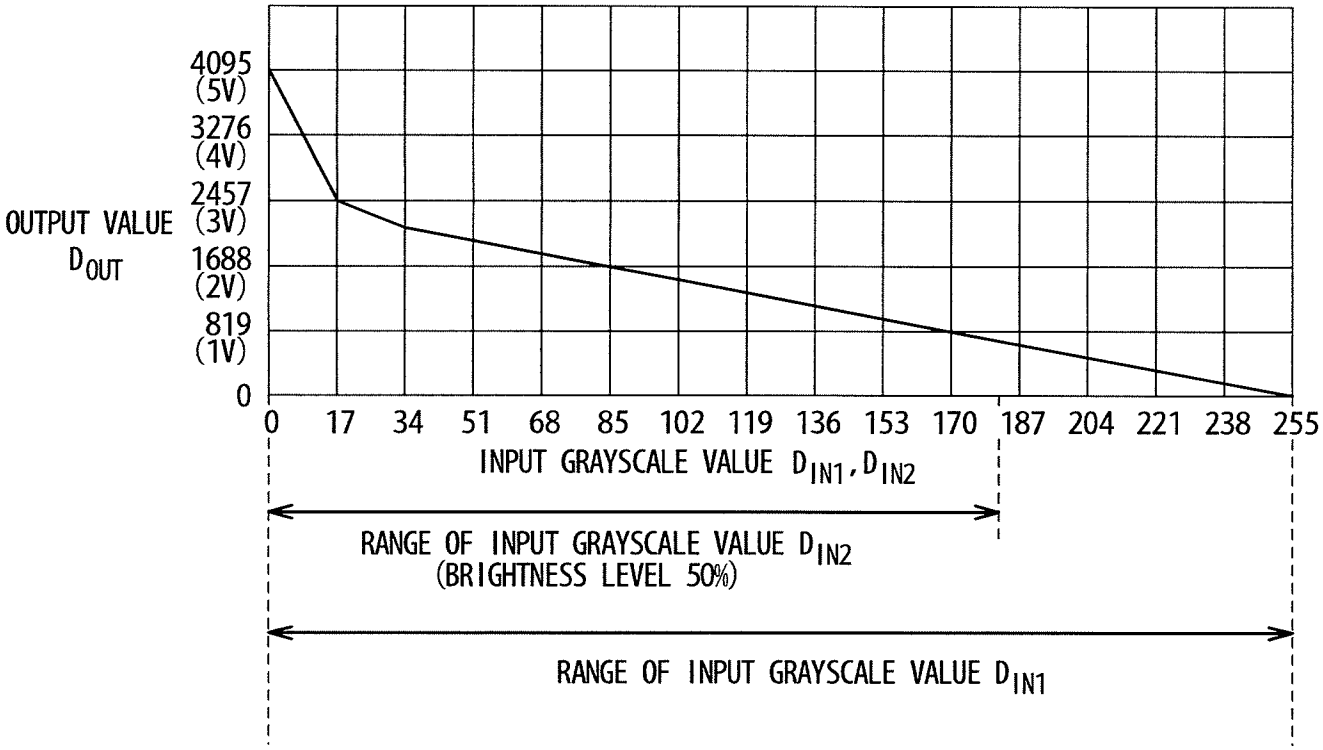
FIG. 4 is a graph illustrating a decrease in the number of representable grayscale levels in a gamma correction circuitry illustrated according to one or more embodiments.

This approach however may lead to a decrease in the number of representable grayscale levels. This is because, as illustrated in FIG. 4, the allowed range of the input grayscale value $D_{IN2}$ is restricted to or below $q^{1/\gamma}$ times of the allowed maximum value $D_{IN}^{MAX}$ of the input grayscale value $D_{IN1}$ in the configuration in which the input grayscale value $D_{IN2}$ obtained as $q^{1/\gamma}$ times of the input grayscale value $D_{IN1}$ is supplied to the maximum-brightness-level-based calculation circuitry 102. When the input grayscale value $D_{IN1}$ is an 8-bit value, the allowed maximum value $D_{IN}^{MAX}$ of the input grayscale value $D_{IN1}$ is 255 ($=2^8-1$). When the screen brightness level is 0.5 times of the allowed maximum brightness level (a screen brightness level of 50%), for example, the input grayscale value $D_{IN2}$ obtained as (186/255) times of the input grayscale value $D_{IN1}$ is supplied to the maximum-brightness-level-based calculation circuitry 102; however, the input grayscale value $D_{IN2}$ supplied to the brightness-level-based calculation circuitry 102 is restricted to the range from zero to 186. This means that the number of representable grayscale levels is decreased.

In one or more of the following embodiments, gamma correction circuitries configured to suppress an increase in the circuit size and avoid the problem of a decrease in the number of representable grayscale levels, and applications of the gamma correction circuitries thus configured are described.

Figure 5:
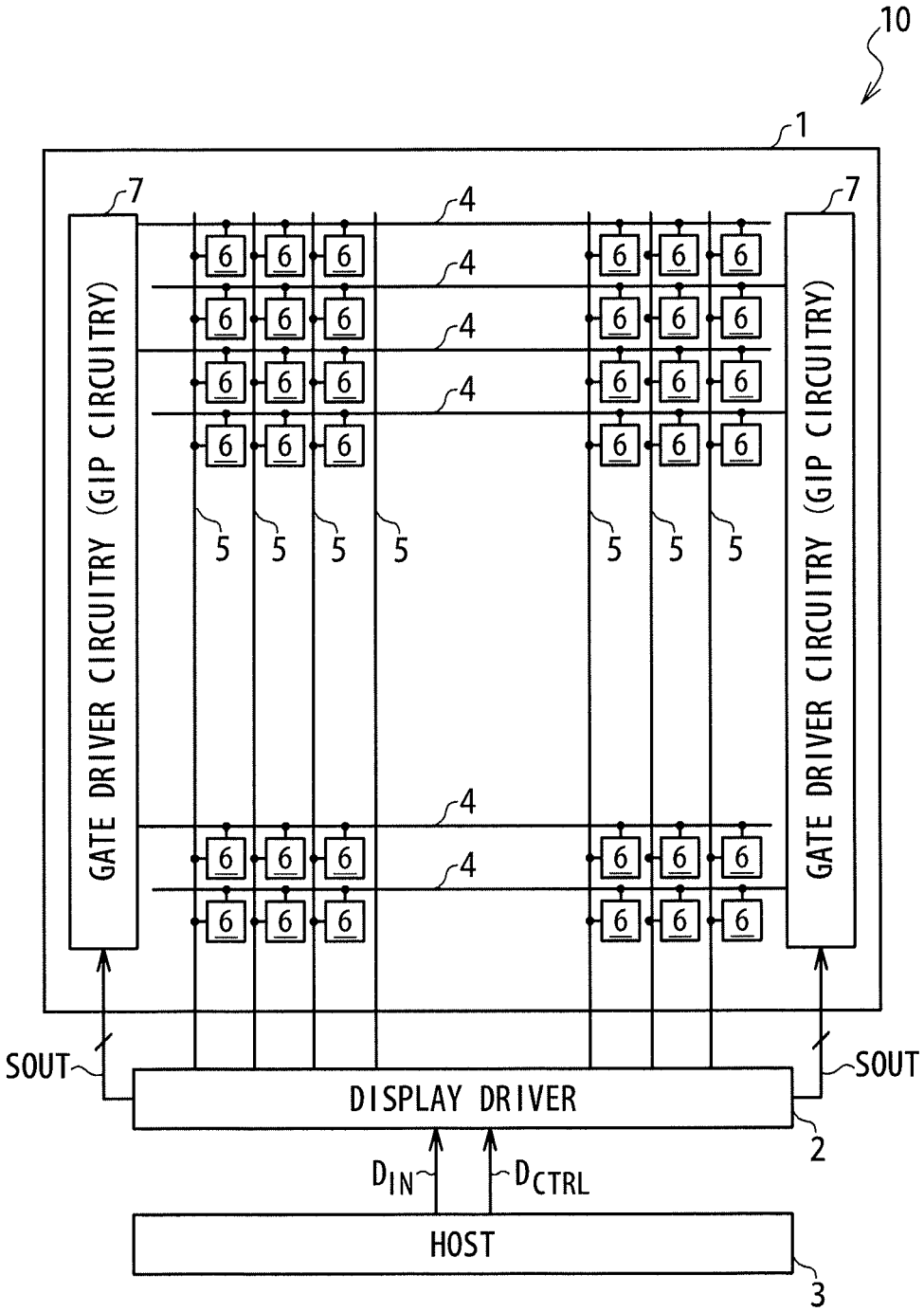
FIG. 5 is a block diagram illustrating a configuration of a display device according to one or more embodiments.

FIG. 5 is a block diagram illustrating the configuration of a display device 10 in one embodiment. The display device 10 is configured as an OLED display device including an OLED display panel 1 and a display driver 2.

The OLED display panel 1 includes gate lines 4, data lines 5, pixel circuits 6 and gate driver circuitries 7. Each of the pixel circuits 6 is disposed at an intersection of a gate line 4 and a data line 5 and includes a light emitting element emitting light of red, green or blue. Pixel circuits 6 including a light emitting element emitting red light are used as R subpixels. Similarly, pixel circuits 6 including a light emitting element emitting green light are used as G subpixels and pixel circuits 6 including a light emitting element emitting blue light are used as B subpixels. The gate driver circuitries 7 drive the gate lines 4 in response to gate control signals SOUT received from the display driver 2. In this embodiment, a pair of gate driver circuitries 7 is provided. One of the gate driver circuitries 7 drives the odd-numbered gate lines 4 and the other drives the even-numbered gate lines 4.

The display driver 2 drives the OLED display panel 1 in response to image data $D_{IN}$ and control data $D_{CTRL}$ received from a host 3, to display an image on the OLED display panel 1. The image data $D_{IN}$ describe the grayscale value of each subpixel of each pixel of the OLED display panel 1. The control data $D_{CTRL}$ include commands and parameters used for controlling the display driver 2. An application processor, a CPU (central processing unit), a DSP (digital signal processor) or the like may be used as the host 3.

Figure 6:
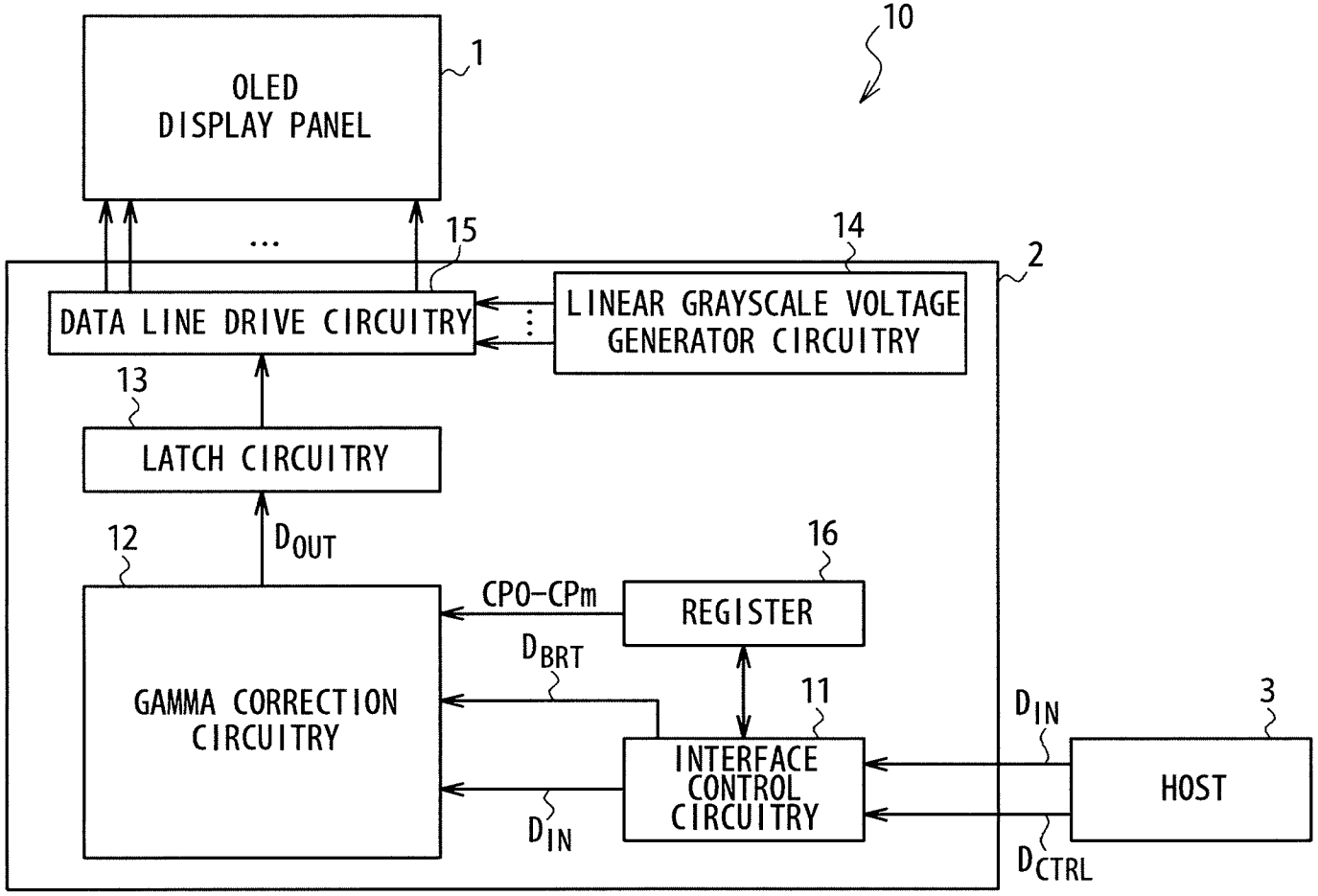
FIG. 6 is a block diagram illustrating a configuration of a display driver according to one or more embodiments.

FIG. 6 is a block diagram illustrating the configuration of the display driver 2 in one embodiment. The display driver 2 includes an interface control circuitry 11, a gamma correction circuitry 12, a latch circuitry 13, a linear grayscale voltage generator circuitry 14, a data line drive circuitry 15 and a register 16.

The interface control circuitry 11 operates as follows. The interface control circuitry 11 forwards the image data $D_{IN}$ received from the host 3 to the gamma correction circuitry 12. The interface control circuitry 11 also stores various control parameters into the register 16 and controls the respective circuitries of the display driver 2 in response to commands included in the control data $D_{CTRL}$. The control parameters stored in the register 16 include parameters used for controlling gamma correction performed in the gamma correction circuitry 12, more particularly, maximum-brightness-level control point data CP0 to CPm. The contents and technical meaning of the maximum-brightness-level control point data CP0 to CPm will be described later in detail.

Additionally, the interface control circuitry 11 supplies a brightness data $D_{BRT}$ specifying the screen brightness level of the OLED display panel 1 (the brightness level of the entire image displayed on the OLED display panel 1) to the gamma correction circuitry 12. In one embodiment, the control data $D_{CTRL}$ received from the host 3 may include the brightness data $D_{BRT}$ and the interface control circuitry 11 may supply the brightness data $D_{BRT}$ included in the control data $D_{CTRL}$ to the gamma correction circuitry 12.

The gamma correction circuitry 12 performs gamma correction on the image data $D_{IN}$ received from the interface control circuitry 11 to generate display data $D_{OUT}$ used to drive the OLED display panel 1. The above-mentioned maximum-brightness-level control point data CP0 to CPm and brightness data $D_{BRT}$ are used in the gamma correction performed in the gamma correction circuitry 12. Details of the gamma correction performed in the gamma correction circuitry 12 will be described later. In various embodiments, in place of the image data $D_{IN}$, image data obtained by performing digital processing (such as scaling (image enlargement and shrinkage) and color adjustment) on the image data $D_{IN}$ received from the interface control circuitry 11 may be supplied to the gamma correction circuitry 12.

The latch circuitry 13 latches the display data $D_{OUT}$ output from the gamma correction circuitry 12 and forwards the latched display data $D_{OUT}$ to the data line drive circuitry 15.

The linear grayscale voltage generator circuitry 14 generates a set of grayscale voltages respectively corresponding to the allowed data values of the display data $D_{OUT}$. In this embodiment, the linear grayscale voltage generator circuitry 14 generates the set of grayscale voltages so that voltage level intervals between adjacent grayscale voltages are the same. In other words, the correspondence relationship between the data values described in the display data $D_{OUT}$ and the corresponding grayscale voltages is linear in this embodiment.

The data line drive circuitry 15 drives the respective data lines 5 with the grayscale voltages corresponding to the data values described in the display data $D_{OUT}$. More specifically, the data line drive circuitry 15 selects the grayscale voltages corresponding to the data values of the display data $D_{OUT}$ from among the grayscale voltages received from the linear grayscale voltage generator circuitry 14 and drives the respective data lines 5 to the selected grayscale voltages.

Next, a description is given of the operation of the gamma correction circuitry 12 according to one or more embodiments. In one embodiment, when the input grayscale value X_IN associated with a subpixel of interest is supplied to the input of the gamma correction circuitry 12, the gamma correction circuitry 12 outputs an output value Y_OUT as the data value of the display data $D_{OUT}$ associated with the subpixel of interest. In this embodiment, the input grayscale value X_IN is an 8-bit data and the output value Y_OUT is a 12-bit data.

In one or more embodiments, the input-output characteristics of the gamma correction performed in the gamma correction circuitry 12, that is, the correspondence relationship between the input grayscale value X_IN and the output value Y_OUT is controlled on the maximum-brightness-level control point data CP0 to CPm and the brightness data $D_{BRT}$. The maximum-brightness-level control point data CP0 to CPm are a set of data which specify the input-output characteristics of the gamma correction for the case where the screen brightness level is the allowed maximum brightness level, that is, the brightness data $D_{BRT}$ specifies the allowed maximum brightness level.

Figure 7:
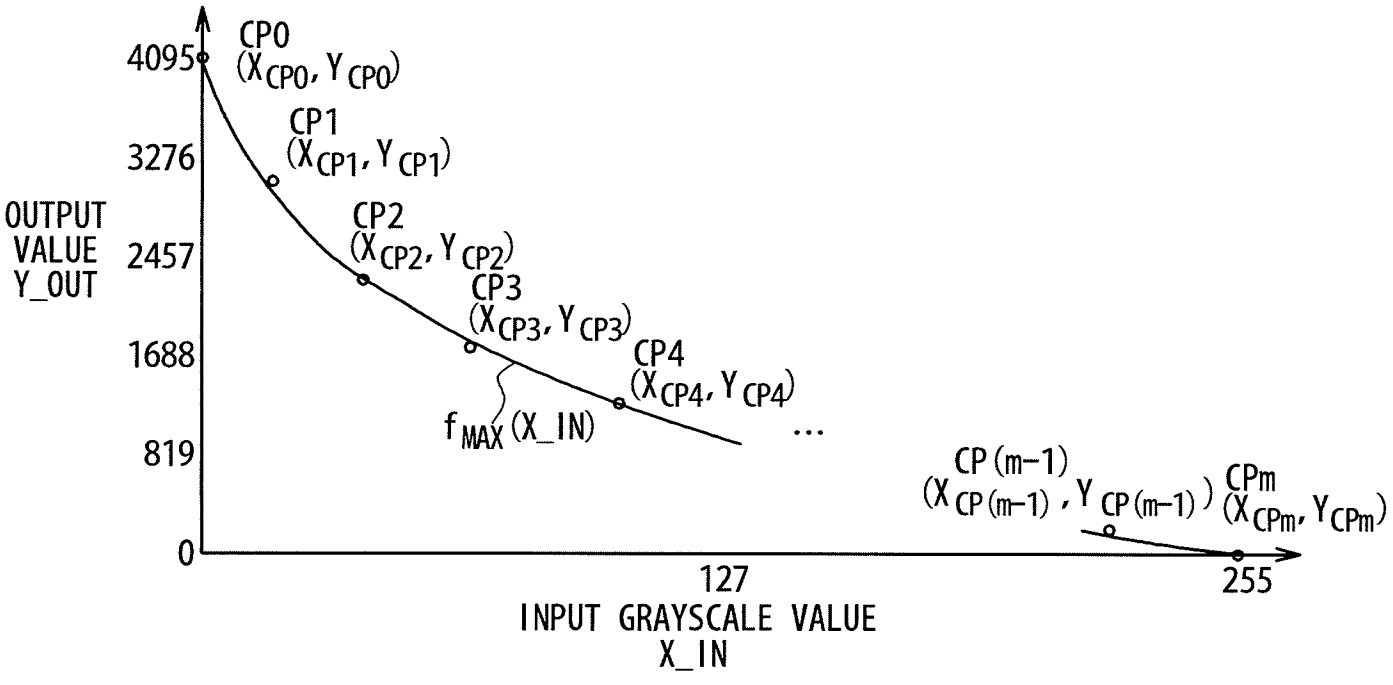
FIG. 7 is a graph illustrating input-output characteristics of gamma correction according to one or more embodiments.

FIG. 7 is a graph schematically illustrating the maximum-brightness-level control point data CP0 to CPm and the input-output characteristics curve determined by the same according to one or more embodiments. The maximum-brightness-level control point data CP0 to CPm specify the coordinates of the control points CP0 to CPm which define the input-output characteristics of the gamma correction in the XY coordinate system in which the X axis represents the input grayscale value X_IN and the Y axis represents the output value Y_OUT, for the case where the screen brightness level is the allowed maximum brightness level. In the embodiment illustrated in FIG. 7, the control point CPi denotes the control point whose coordinates are specified by the maximum-brightness-level control point data CPi, where i is an integer from zero to "m", and CPi($X_{CPi}$, $Y_{CPi}$) denotes the coordinates of the control point CPi, where $X_{CPi}$ is the X coordinate (the coordinate indicating the position in the X axis direction) of the control point CPi and $Y_{CPi}$ is the Y coordinate (the coordinate indicating the position in the Y axis direction) of the control point CPi. The X coordinate of $X_{CPi}$ of each control point CPi satisfies the condition given below:

$$X_{CP0}<X_{CP1}<\ldots<X_{CPi}<X_{CP(i+1)}<\ldots<X_{CP(m-1)}<X_{CPm},$$

where the X coordinate $X_{CP0}$ of the control point CP0 is the allowed minimum value of the input grayscale value X_IN (that is, zero) and the X coordinate $X_{CPm}$ of the control point CPm is the allowed maximum value of the input grayscale value X_IN (that is, 255).

In various embodiments, when the screen brightness level is the allowed maximum brightness level (that is, the brightness data $D_{BRT}$ specifies the allowed maximum brightness level), the gamma correction circuitry 12 calculates the output value Y_OUT as the Y coordinate of the point which is positioned on the curve defined by the control points CP0 to CPm and has an X coordinate equal to the input grayscale value X_IN. In one embodiment, the gamma correction circuitry 12 may calculate the output value Y_OUT corresponding to the input grayscale value X_IN by using a Bezier curve defined by the control points CP0 to CPm. In this case, the gamma correction circuitry 12 may calculate the output value Y_OUT as the Y coordinate of the point which is positioned on this Bezier curve and has an X coordinate equal to the input grayscale value X_IN.

In one example, the gamma correction circuitry 12 may calculate the output value Y_OUT as the Y coordinate of the point which is positioned on a second order Bezier curve defined by the control points CP0 to CPm and has an X coordinate equal to the input grayscale value X_IN. In one or more embodiments, when the output value Y_OUT is calculated on the basis of a second order Bezier curve, which can be defined with three control points, the gamma correction circuitry 12 may select three control points CP(2k) to CP(2(k+1)) having X coordinates close to the input grayscale value X_IN from among the control points CP0 to CPm, and calculate the output value Y_OUT as the Y coordinate of the point which is positioned on the second order Bezier curve defined by the control points CP(2k) to CP(2(k+1)) and has an X coordinate equal to the input grayscale value X_IN. In one or more embodiments, when a second order Bezier curve is used to calculate the output value Y_OUT, 2p+1 control points CP0 to CPm are defined by the maximum-brightness-level control point data CP0 to CPm, where p is an integer equal to or more than two. In this case, m=2p.

The Bezier curve used to calculate the output value Y_OUT is may not be limited to a second-order Bezier curve. In various embodiments, an $n^{th}$ order Bezier curve can be defined with n+1 control points. Accordingly, when the output value Y_OUT is calculated on the basis of an $n^{th}$ order Bezier curve, the gamma correction circuitry 12 may select n+1 control points CP(k×n) to CP((k+1)×n) having X coordinates close to the input grayscale value X_IN from among the control points CP0 to CPm, and calculate the output value Y_OUT as the Y coordinate of the point which is positioned on the $n^{th}$ order Bezier curve defined by the n+1 control points CP(k×n) to CP((k+1)×n)) and has an X coordinate equal to the input grayscale value X_IN. When an $n^{th}$ order Bezier curve is used to calculate the output value Y_OUT, p×n+1 control points CP0 to CPm are defined by the maximum-brightness-level control point data CP0 to CPm, where p is an integer equal to or more than two. In this case, m=n×p.

Figure 8:
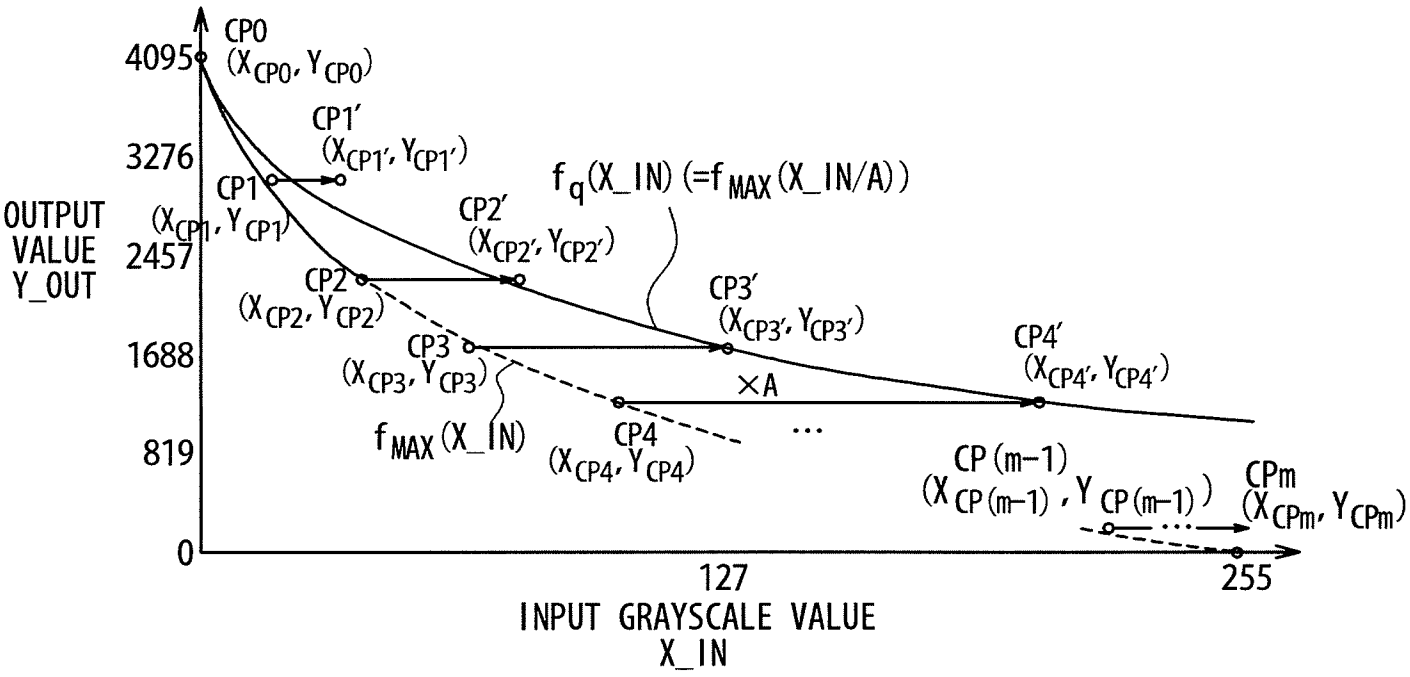
FIG. 8 is a graph illustrating the input-output characteristics of gamma correction according to one or more embodiments.

In various embodiments, w the brightness data DBRT specifies a screen brightness level other than the allowed maximum brightness level, as illustrated in FIG. 8. In such embodiments, the gamma correction circuitry 12 calculates the output value Y_OUT under a condition that the input-output characteristics of the gamma correction for the specified screen brightness level is represented by a curve obtained by enlarging the curve defined with the control points CP0 to CPm to A times, where A is a coefficient depending to the ratio q of the screen brightness level specified by the brightness data DBRT to the allowed maximum brightness level. An expression used to obtain the coefficient A will be described later. The gamma correction circuitry 12 calculates the output value Y_OUT as the Y coordinate of the point which is positioned on the curve obtained by enlarging the curve defined with the control points CP0 to CPm to A times and has an X coordinate equal to the input grayscale value X_IN. In other words, in this embodiment, when the input-output characteristics of the gamma correction circuitry 12 for the case where the screen brightness level is the allowed maximum brightness level are represented by the following expression (2a):

$$Y_OUT = f\mathrm{MAX}(X_IN), \tag{2a}$$

the output value Y_OUT is calculated under a condition that the input-output characteristics of the gamma correction circuitry 12 for the case where the screen brightness level is q times of the allowed maximum brightness level are represented by the following expression (2b):

$$Y_OUT = f\mathrm{MAX}(X_IN/A). \tag{2b}$$

The curve represented as Y_OUT=fMAX(X_IN/A) can be defined with correction control points CP0' to CPm' obtained by multiplying the X coordinates of the control points CP0 to CPm, and therefore the output value Y_OUT is calculated as the Y coordinate of the point which is positioned on the curve defined with the correction control points CP0' to CPm' and has an X coordinate equal to the input grayscale value X_IN, when the screen brightness level is q times of the allowed maximum brightness level. The correction control points CP0' to CPm' are control points used in the gamma correction. The coordinates CPi' (XCPi', YCPi') of the correction control point CPi' are obtained from the coordinates CPi(XCPi, YCPi) of the control points CPi in accordance with the following expressions (3b) and (3c):

$$XCPi' = A \cdot XCPi, \text{ and} \tag{3b}$$

$$YCPi' = YCPi \tag{3c}$$

In one example, the gamma correction circuitry 12 may calculate the output value Y_OUT as the Y coordinate of the point which is positioned on a second order Bezier curve defined with the correction control points CP0' to CPm' and has an X coordinate equal to the input grayscale value X_IN. It should be noted that the Bezier curve used to calculate the output value Y_OUT is not limited to a second order Bezier curve.

As described above, the coordinate A is determined depending on the ratio q of the screen brightness level specified by the brightness data $D_{BRT}$ to the allowed maximum brightness level. When the gamma value of the display device 10 is γ, the coefficient A satisfies the following expression (4a):

$$(X_IN/A)^{\gamma} = q \cdot (X_IN)^{\gamma}. \tag{4a}$$

Accordingly, the coefficient A can be determined in accordance with the following expression (4b):

$$A = 1/q^{(1/\gamma)}. \tag{4b}$$

When the gamma value γ is 2.2 and q is 0.5 (that is, the screen brightness level is 0.5 times of the allowed maximum brightness level), for example, A is the obtained in accordance with the following expression (4c):

$$A = \frac{1}{(0.5)^{\frac{1}{2.2}}} = \frac{255}{186}. \tag{4c}$$

In other words, when the screen brightness level is 0.5 times of the allowed maximum brightness level (a screen brightness level of 50%), the output value Y_OUT is calculated as the Y coordinate of the point which is positioned on the curve specified by the correction control points CP0' to CPm' obtained by multiplying the X coordinates of the control points CP0 to CPm by (255/186) times and has an X coordinate equal to the input grayscale value X_IN. In general, when the screen brightness level is q times of the allowed maximum brightness level, the output value Y_OUT is calculated as the Y coordinate of the point which is positioned on the curve specified by the correction control points CP0' to CPm' obtained by multiplying the X coordinates of the control points CP0 to CPm by 1/q(1/γ) times and has an X coordinate equal to the input grayscale value X_IN.

Next, a description is given of various examples of the configuration of the gamma correction circuitry 12 for achieving the above-described operation.

Figure 9:
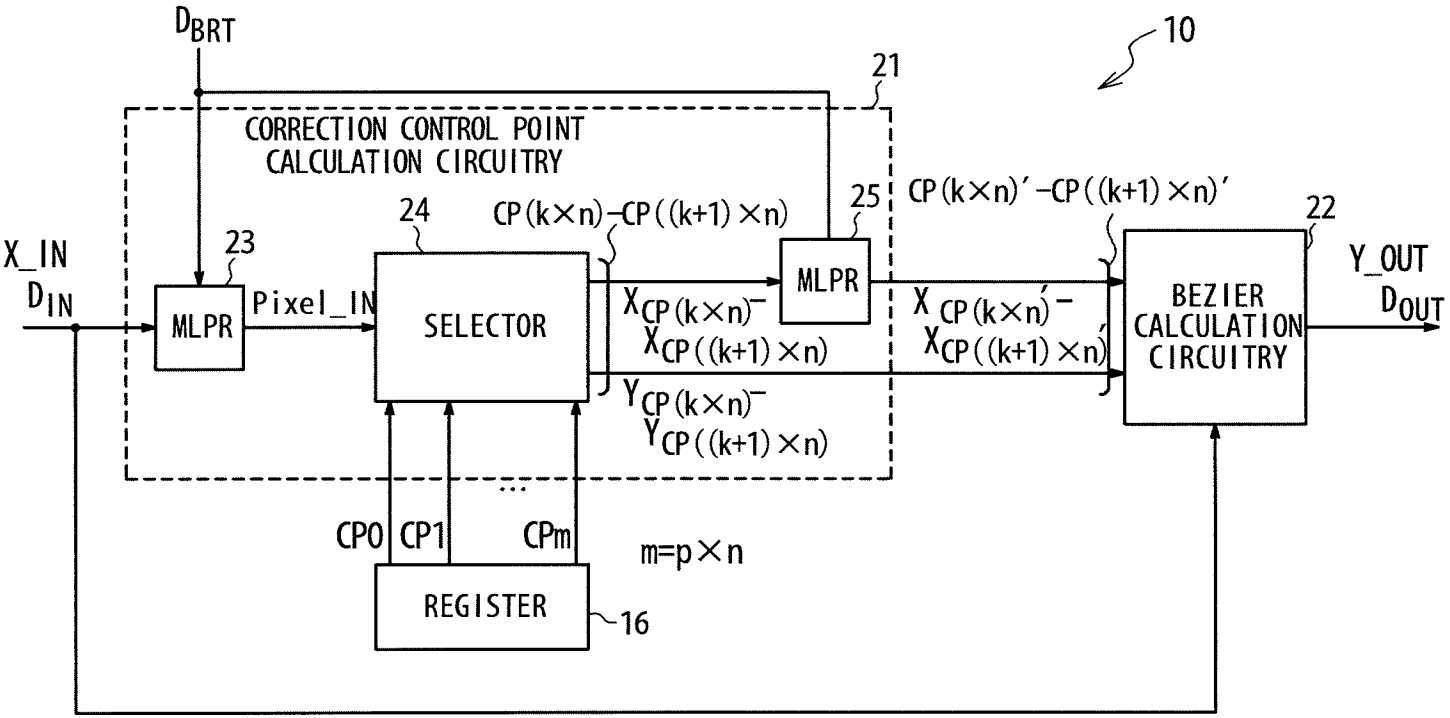
FIG. 9 is a block diagram illustrating a configuration of a gamma correction circuitry according to one or more embodiments.

FIG. 9 is a block diagram illustrating the configuration of the gamma correction circuitry 12 in one embodiment. The gamma correction circuitry 12 and the register 16, which stores therein the maximum-brightness-level control point data CP0 to CPm, constitute a correction circuitry which performs the gamma correction. The gamma correction circuitry 12 illustrated in FIG. 9 is configured to calculate the output value Y_OUT from the input grayscale value X_IN using an $n^{th}$ order Bezier curve. In this case, m is p×n, where p is an integer of two or more, and the coordinates of the (p×n+1) control points CP0 to CPm are specified by the maximum-brightness-level control point data CP0 to CPm.

The gamma correction circuitry 12 includes a correction control point calculation circuitry 21 and a Bezier curve calculation circuitry 22. The correction control point calculation circuitry 21 determines n+1 correction control points CP(k×n)' to CP((k+1)×n)' used to calculate the output value Y_OUT corresponding to the input grayscale value X_IN from the brightness data $D_{BRT}$, the input grayscale value X_IN and the maximum-brightness-level control point data CP0 to CPm received from the register 16, where k is an integer from zero to p−1. The Bezier curve calculation circuitry 22 calculates the Y coordinate of the point which is positioned on the $n^{th}$ Bezier curve defined with the n+1 correction control points CP(k×n)' to CP((k+1)×n)' and has an X coordinate equal to the input grayscale value X_IN, and outputs the calculated Y coordinate as the output value Y_OUT.

The correction control point calculation circuitry 21 includes a multiplier circuitry 23, a selector 24 and a multiplier circuitry 25. The multiplier circuitry 23 and the selector 24 constitute a select circuitry configured to select (n+1) control points CP(k×n) to CP((k+1)×n) from among the control points CP0 to CPm on the basis of the input grayscale value X_IN and the screen brightness level specified by the brightness data $D_{BRT}$. More specifically, in various embodiments, the multiplier circuitry 23 calculates a control-point-selecting grayscale value Pixel_in as a value obtained by multiplying the input grayscale value X_IN by the inverse number 1/A of the coefficient A (that is, $q^{(1/\gamma)}$). In such embodiments, q is the ratio of the screen brightness level specified by the brightness data $D_{BRT}$ to the allowed maximum brightness level and the coefficient A is given by the above-described expression (4b). The selector 24 selects (n+1) control points CP(k×n) to CP((k+1)×n) from among the control points CP0 to CPm, on the basis of the control-point-selecting grayscale value Pixel_in. In the following, the control points CP(k×n) to CP((k+1)×n) selected by the selector 24 are referred to as the selected control points CP(k×n) to CP((k+1)×n).

In various embodiments, the multiplier circuitry 25 calculates the X coordinates $X_{CP(k\times n)'}$ to $X_{CP((k+1)\times n)}'$ of the correction control points CP(k×n)' to CP((k+1)×n)' by multiplying the X coordinates $X_{CP(k\times n)}$ to $X_{CP((k+1)\times n)}$ of the selected control points CP(k×n) to CP((k+1)×n) by A. The Y coordinates $Y_{CP(k\times n)}$ to $Y_{CP((k+1)\times n)}$ of the selected control points CP(k×n) to CP((k+1)×n) are used as the Y coordinates $Y_{CP(k\times n)}'$ to $Y_{CP((k+1)\times n)}'$ of the correction control points CP(k×n)' to CP((k+1)×n)' without modification.

Figure 10:
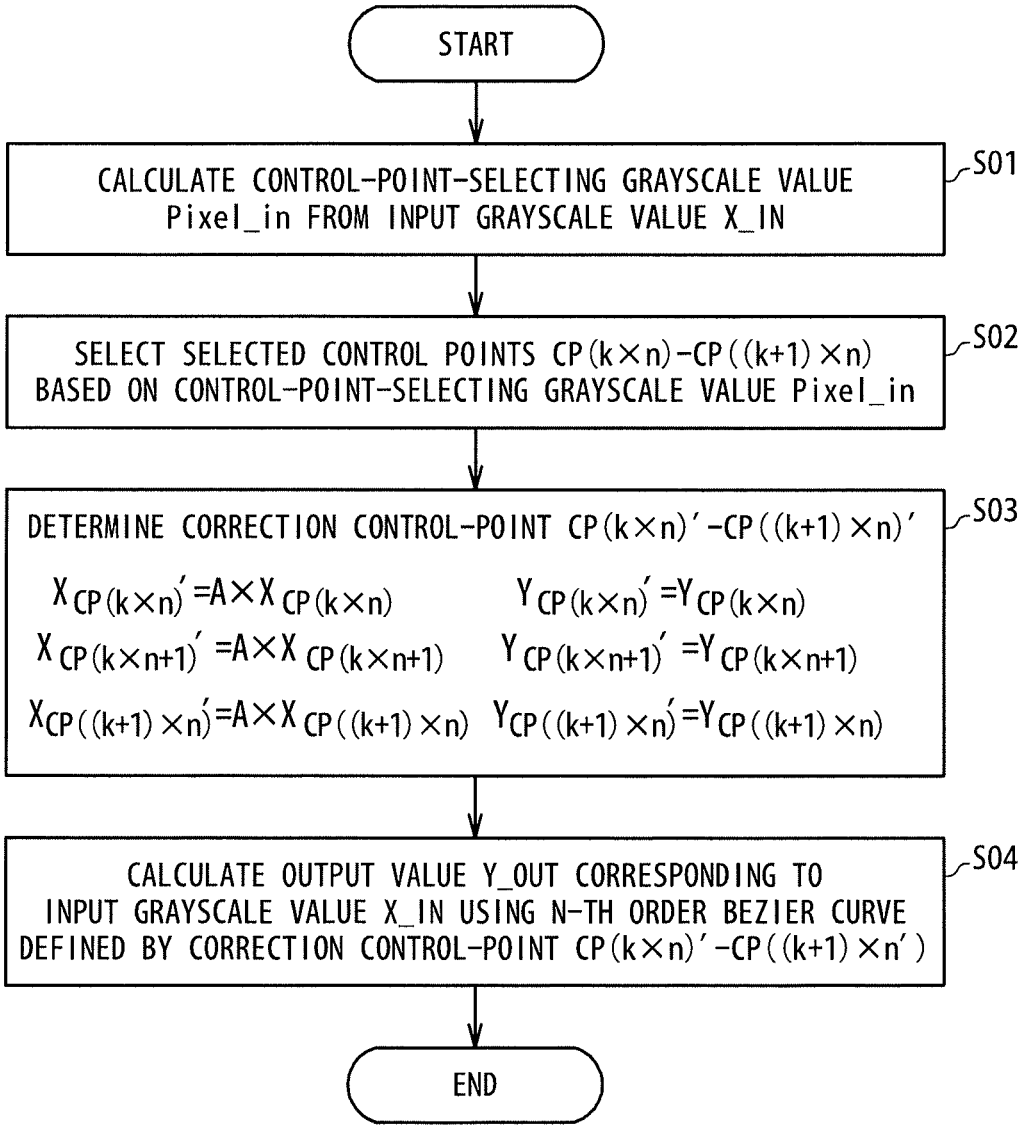
FIG. 10 is a flowchart illustrating operation of gamma correction circuitry according to one or more embodiments.

FIG. 10 is a flowchart illustrating an embodiment of the operation of the gamma correction circuitry 12 illustrated in FIG. 9. When an input grayscale value X_IN indicative of the grayscale level of a certain subpixel (a subpixel of interest) is supplied to the gamma correction circuitry 12, a control-point-selecting grayscale value Pixel_in is calculated from the input grayscale value X_IN by the multiplier circuitry 23 at step S01. As described above, the control-point-selecting grayscale value Pixel_in is obtained by multiplying the input grayscale value X_IN by the inverse number 1/A of the coefficient A (that is, by $q^{(1/\gamma)}$).

This is followed by selecting n+1 control points CP(k×n) to CP((k+1)×n) from among the control points CP0 to CPm on the basis of the control-point-selecting grayscale value Pixel_in at step S02. The selection of the n+1 control points CP(k×n) to CP((k+1)×n) is achieved by the selector 24. In one or more embodiments, the n+1 control points CP(k×n) to CP((k+1)×n) are selected as follows.

The $n^{th}$ order Bezier curve passes through the control points CP0, CPn, CP(2n), . . . CP(p×n) out of the m+1 (=p×n+1) control points CP0 to CPm. The remaining control points are not necessary positioned on the $n^{th}$ order Bezier curve, although determining the shape of the $n^{th}$ order Bezier curve. The selector 24 compares the control-point-selecting grayscale value Pixel_in with the X coordinates of the control points through which the $n^{th}$ order Bezier curve passes, and selects (n+1) control points CP(k×n) to CP((k+1)×n) in response to the result of the comparison.

In one or more embodiments, when the control-point-selecting grayscale value Pixel_in is larger than the X coordinate of the control point CP0 and smaller than the X coordinate of the control point CPn, the selector 24 selects the control points CP0 to CPn. When the control-point-selecting grayscale value Pixel_in is larger than the X coordinate of the control point CPn and smaller than the X coordinate of the control point CP(2n), the selector 24 selects the control points CPn to CP(2n). In one or more embodiments, when the control-point-selecting grayscale value Pixel_in is larger than the X coordinate $X_{CP(k\times n)}$ of the control point CP(k×n) and smaller than the X coordinate $X_{CP((k+1)\times n)}$ of the control point CP((k+1)×n), the selector 24 selects the control points CP(k×n) to CP((k+1)×n).

When the control-point-selecting grayscale value Pixel_in is equal to the X coordinate $X_{CP(k\times n)}$ of the control point CP(k×n), in one embodiment, the selector 24 selects the control points CP(k×n) to CP((k+1)×n). In such an embodiments, the selector 24 selects the control points CP((p−1)×n) to CP(p×n) when the control-point-selecting grayscale value Pixel_in is equal to the X coordinate of the control point CP(p×n).

In some embodiments, the selector may select the control points CP(k×n) to CP((k+1)×n) when the control-point-selecting grayscale value Pixel_in is equal to the X coordinate $X_{CP((k+1)\times n)}$ of the control point CP((k+1)×n). In such embodiments, the selector 24 selects the control points CP0 to CPn when the control-point-selecting grayscale value Pixel_in is equal to the X coordinate of the control point CP0.

Further, in some embodiments, this is followed by determining the correction control points CP(k×n)' to CP((k+1)×n)' at step S03. In one embodiment, the X coordinates $X_{CP(k\times n)}'$ to $X_{CP((k+1)\times n)}'$ of the correction control points CP(k×n)' to CP((k+1)×n)' are calculated as the products of the coefficient A and the X coordinates $X_{CP(k\times n)}$ to $X_{CP((k+1)\times n)}$ of the selected control points CP(k×n) to CP((k+1)×n), respectively, by the multiplier circuitry 25. In other words, the multiplier circuitry 25 calculates the X coordinates $X_{CP(k\times n)}'$ to $X_{CP((k+1)\times n)}'$ of the correction control points CP(k×n)' to CP((k+1)×n)' in accordance with the following expressions (5a):

$$X'_{CP(k\times n)} = A \cdot X_{CP(k\times n)}, \tag{5a}$$

$$X'_{CP((k\times n)+1)} = A \cdot X_{CP((k\times n)+1)}, \ldots,$$

and $$X'_{CP((k+1)\times n)} = A \cdot X_{CP((k+1)\times n)}.$$

The Y coordinates $Y_{CP(k\times n)}'$ to $Y_{CP((k+1)\times n)}'$ of the correction control points CP(k×n)' to CP((k+1)×n)' are determined as being equal to the Y coordinates $Y_{CP(k\times n)}$ to $Y_{CP((k+1)\times n)}$ of the selected control points CP (k×n) to CP((k+1)×n), respectively. In other words, the Y coordinates $Y_{CP(k\times n)}'$ to $Y_{CP((k+1)\times n)}'$ of the correction control points CP(k×n)' to CP((k+1)×n)' are represented by the following expressions (5b):

$$Y'_{CP(k\times n)} = Y_{CP(k\times n)}, \quad (5b)$$

$$Y'_{CP((k\times n)+1)} = Y_{CP((k\times n)+1)}, \ldots ,$$

and $$Y'_{CP((k+1)\times n)} = Y_{CP((k+1)\times n)}.$$

The X and Y coordinates of the correction control points CP(k×n)' to CP((k+1)×n)' thus determined are supplied to the Bezier curve calculation circuitry 22. Further, the output value Y_OUT corresponding to the input grayscale value X_IN is calculated by the Bezier curve calculation circuitry 22 at step S04. The output value Y_OUT is calculated as the Y coordinate of the point which is positioned on the $n^{th}$ order Bezier curve defined with the (n+1) correction control points CP(k×n)' to CP((k+1)×n)' and has an X coordinate equal to the input grayscale value X_IN.

Although the above-described embodiment describes the configuration in which the gamma correction circuitry 12 is supplied with the maximum-brightness-level control point data CP0 to CPm, which indicate the coordinates of the control points specifying the input-output characteristics of the gamma correction for the case where the screen brightness level is the allowed maximum brightness level (that is, the case where the brightness data $D_{BRT}$ specifies the allowed maximum brightness level). In one or more embodiments, a set of control point data which indicate the coordinates of control points specifying the input-output characteristics of the gamma correction for the case where the screen brightness level is a specific brightness level (that is, the case where the brightness data $D_{BRT}$ specifies the specific brightness level) may be used in place of the maximum-brightness-level control point data CP0 to CPm. Further, the n+1 correction control points CP(k×n)' to CP((k+1)×n)' can be calculated by defining the parameter q, which is included in expression (4b) used to calculate the coefficient A, as the ratio of the brightness level specified by the brightness data $D_{BRT}$ to the specific brightness level.

In various embodiments, the order of the Bezier curve used to calculate the output value Y_OUT may be selected depending to the required preciseness, not limited to a specific order. The use of a second order Bezier curve to calculate the output value Y_OUT however allows calculating the output value Y_OUT accurately while simplifying the configuration of the Bezier curve calculation circuitry 22. In the following, a description is given of an exemplary configuration and operation of the Bezier curve calculation circuitry 22 for the case where the output value Y_OUT is calculated using a second order Bezier curve. In various embodiments, the X and Y coordinates of three correction control points CP(2k)', CP(2k+1)' and CP(2k+2)' are supplied to the inputs of the Bezier curve calculation circuitry 22 when the output value Y_OUT is calculated using a second order Bezier curve.

Figure 11:
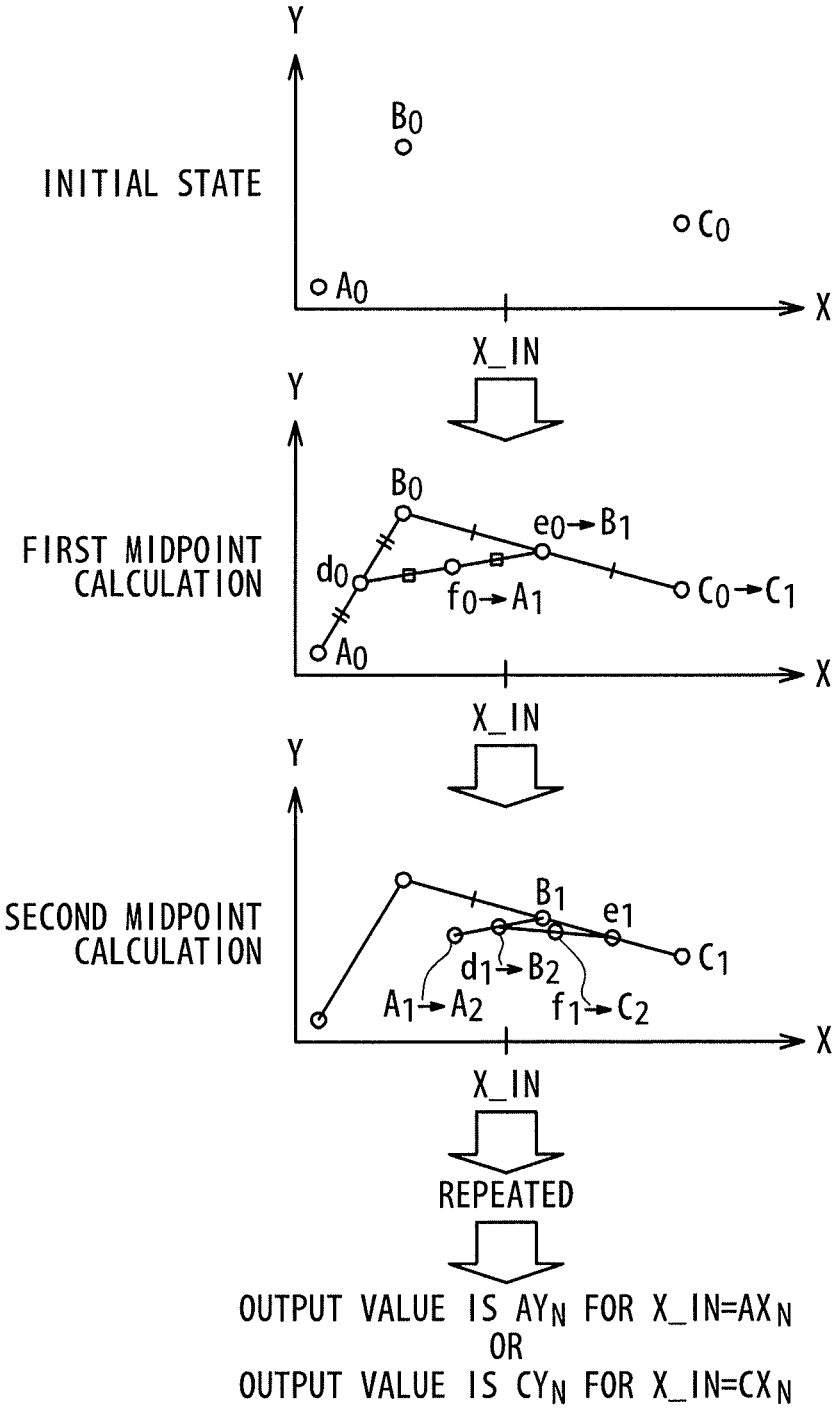
FIG. 11 illustrates a Bezier curve calculation circuitry according to one or more embodiments.

In the following, a description is first given of the calculation algorithm performed in the Bezier curve calculation circuitry 22. FIG. 11 schematically illustrates the calculation algorithm performed in the Bezier curve calculation circuitry 22 in one embodiment and FIG. 12 is a flowchart illustrating the calculation procedure.

Figure 12:
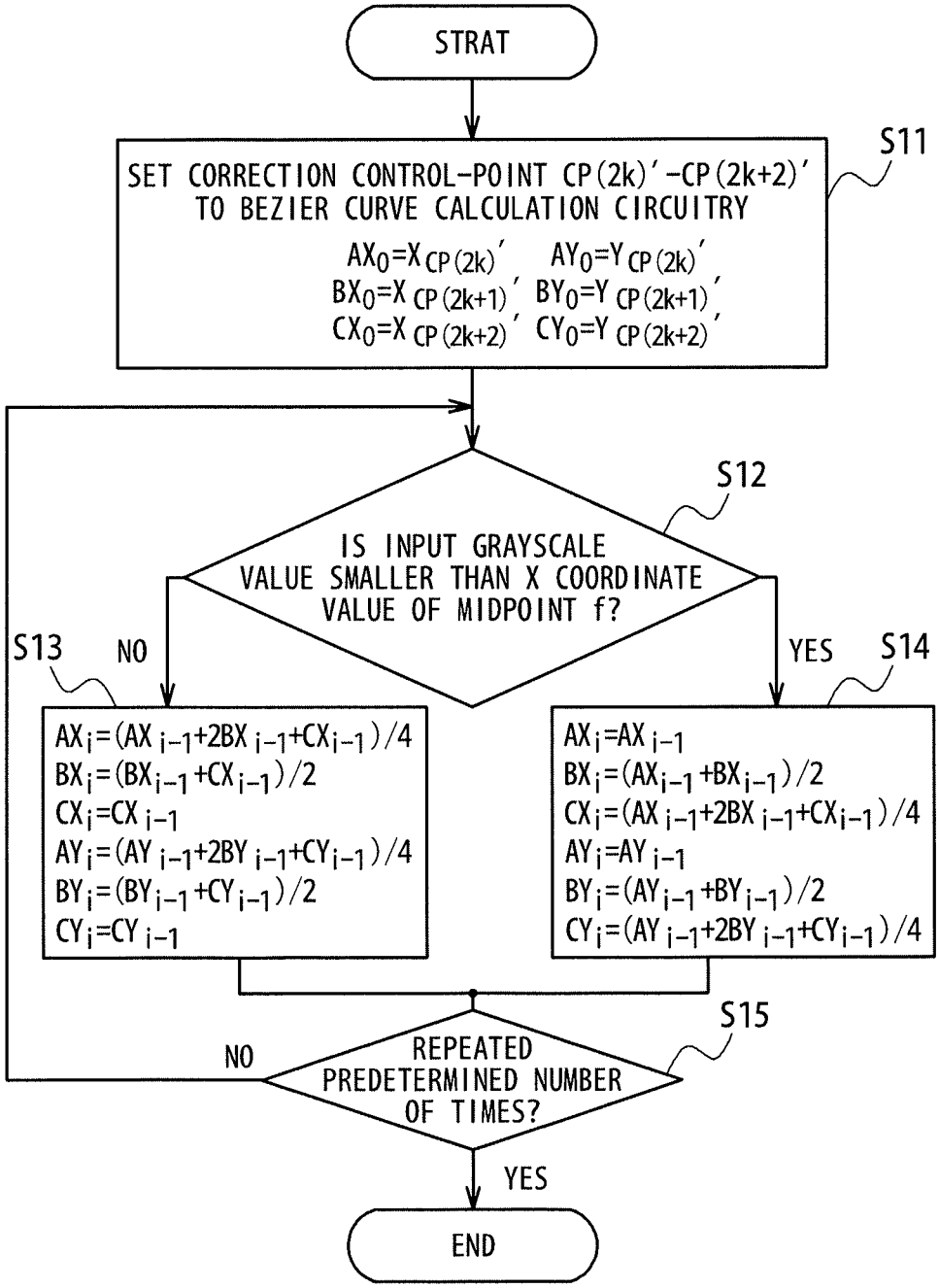
FIG. 12 is a flowchart illustrating a calculation procedure performed in Bezier curve calculation circuitry according to one or more embodiments.

As illustrated in FIG. 12, the three correction control points (2k)' to CP(2k+2)' are set to the Bezier curve calculation circuitry 22 as initial settings at step S11. For conciseness of the description, the correction control points (2k)' to CP(2k+2)' set to the Bezier curve calculation circuitry 22 are hereinafter referred to as control points $A_0$, $B_0$ and $C_0$, respectively. With reference to FIG. 11, the coordinates $A_0$ ($AX_0$, $AY_0$), $B_0$ ($BX_0$, $BY_0$) and $C_0$($CX_0$, $CY_0$) of the control points $A_0$, $B_0$ and $C_0$ are respectively represented as follows:

$$A_0(AX_0,AY_0)=(X_{CP(2k)}',Y_{CP(2k)}'),$$

$$B_0(BX_0,BY_0)=(X_{CP(2k+1)}',Y_{CP(2k+1)}'), \text{ and}$$

$$C_0(CX_0,CY_0)=(X_{CP(2k+2)}',Y_{CP(2k+2)}')$$

As described in the following, the output value Y_OUT may be calculated by repeating calculation of midpoints. One unit of this repeated calculation is referred to as the midpoint calculation, hereinafter. In various embodiments, a midpoint of adjacent two of the three control points may be referred to as the first order midpoint and the midpoint of the two first order midpoints may be referred to as the second order midpoint.

In the first midpoint calculation, with respect to the initially-given control points $A_0$, $B_0$ and $C_0$ (that is, the three correction control points CP(2k)', CP(2k+1)' and CP (2k+2)'), a first order midpoint do which is the midpoint of the control points $A_0$ and $B_0$ and a first order midpoint $e_0$ which is the midpoint of the control points $B_0$ and $C_0$ are calculated, and a second order midpoint $f_0$ which is the midpoint of the first order midpoints do and $e_0$ is further calculated. The second order midpoint $f_0$ is a point on the Bezier curve defined with the three control points $A_0$, $B_0$ and $C_0$. The coordinates ($X_{f0}$, $Y_{f0}$) of the second order midpoint $f_0$ are represented by the following expressions (6a) and (6b):

$$X_{f0}=(AX_0+2BX_0+CX_0)/4, \text{ and} \quad (6a)$$

$$Y_{f0}=(AY_0+2BY_0+CY_0)/4. \quad (6b)$$

Three control points $A_1$, $B_1$ and $C_1$ used for the next midpoint calculation (the second midpoint calculation) are selected from the control point $A_0$, the first order midpoint do, the second order midpoint $f_0$, the first order midpoint $e_0$ and the control point $C_0$ in response to the result of the comparison between the input grayscale X_IN and the X coordinate $X_{f0}$ of the second order midpoint $f_0$. In one or more embodiments, the control points $A_1$, $B_1$ and $C_1$ are selected as follows:

$$\text{When } X_{f0} \geq X_IN \quad (A)$$

In this case, the three points having the smallest three X coordinates (the three leftmost points), that is, the control point $A_0$, the first order midpoint do and the second order midpoint $f_0$ are selected as the control points $A_1$, $B_1$ and $C_1$. In other words, $$A_1=A_0, B_1=d_0, \text{ and } C_1=f_0. \quad (7a)$$

$$\text{When } X_{f0} < X_IN \quad (B)$$

In this case, the three points having the largest three X coordinates (the three rightmost points), that is, the second order midpoint $f_0$, the first order midpoint $e_0$ and the control point $C_0$ are selected as the control points $A_1$, $B_1$ and $C_1$. In other words, $$A_1=f_0, B_1=e_0, \text{ and } C_1=C_0. \quad (7b)$$

The second midpoint calculation is performed in a similar manner. With respect to the control points $A_1$, $B_1$ and $C_1$, the first order midpoint $d_1$ of the control points $A_1$ and $B_1$ and the first order midpoint $e_1$ the control points $B_1$ and $C_1$ are calculated, and the second order midpoint $f_1$ of the first order midpoints $d_1$ and $e_1$ is further calculated. The second order midpoint $f_1$ is a point on the desired second-order Bezier curve. Three control points $A_2$, $B_2$ and $C_2$ may be used for the next midpoint calculation (the third midpoint calculation). In one embodiment, the three control points may be selected from the control point $A_1$, the first order midpoint $d_1$, the second order midpoint $f_1$, the first order midpoint $e_1$ and the control point $C_1$ in response to the result of the comparison between the input grayscale X_IN and the X coordinate $X_{f1}$ of the second order midpoint $f_1$.

As is illustrated in FIG. 12, the following calculation is performed in the $i^{th}$ midpoint calculation at steps S12 to S14:

$$\text{When } (AX_{i-1}+2BX_{i-1}+CX_{i-1})/4 \geq X_IN, \tag{A}$$

$$AX_i=AX_{i-1}, \tag{8a}$$

$$BX_i=(AX_{i-1}+BX_{i-1})/2, \tag{9a}$$

$$CX_i=(AX_{i-1}+2BX_{i-1}+CX_{i-1})/4, \tag{10a}$$

$$AY_i=AY_{i-1}, \tag{11a}$$

$$BY_i=(AY_{i-1}+BY_{i-1})/2, \text{ and} \tag{12a}$$

$$CY_i=(AY_{i-1}+2BY_{i-1}+CY_{i-1})/4. \tag{13a}$$

$$\text{When } (AX_{i-1}+2BX_{i-1}+CX_{i-1})/4 < X_IN, \tag{B}$$

$$AX_i=(AX_{i-1}+2BX_{i-1}+CX_{i-1})/4, \tag{8b}$$

$$BX_i=(BX_{i-1}+CX_{i-1})/2, \tag{9b}$$

$$CX_i=CX_{i-1}, \tag{10b}$$

$$AY_i=(AY_{i-1}+2BY_{i-1}+CY_{i-1})/4, \tag{11b}$$

$$BY_i=(BY_{i-1}+CY_{i-1})/2, \text{ and} \tag{12b}$$

$$CY_i=CY_{i-1}. \tag{13b}$$

It would be apparent to a person skilled in the art that the equal sign may be attached to any one of the inequality signs recited in conditions (A) and (B).

The midpoint calculation is repeated a desired number of times in a similar manner at step S15.

In various embodiments, when a midpoint calculation is performed, the control points $A_i$, $B_i$ and $C_i$ approach the second order Bezier curve and the X coordinates of the control points $A_i$, $B_i$ and $C_i$ also approach the input grayscale value X_IN. The output value Y_OUT is finally obtained from the Y coordinate of at least one of the control points $A_N$, $B_N$ and $C_N$ obtained through the $N^{th}$ midpoint calculation. For example, the output value Y_OUT may be determined as the Y coordinate of an arbitrarily-selected one of the control points $A_N$, $B_N$ and $C_N$. Alternatively, the output value Y_OUT may be determined as the average value of the Y coordinates of the control points $A_N$, $B_N$ and $C_N$.

In various embodiments, when the number of times N of the midpoint calculations is relatively small, the preciseness of the output value Y_OUT can be improved by increasing the number of times N of the midpoint calculations. In various embodiments, once the number of times N of the midpoint calculations reaches the number of bits of the output value Y_OUT, the preciseness of the output value Y_OUT is not further improved thereafter. In one embodiment, the number of times N of the midpoint calculations is equal to the number of bits of the output value Y_OUT. For example, in this embodiment, in which the output value Y_OUT is a 12-bit data, the number of times N of the midpoint calculations may be 12.

Figure 13:
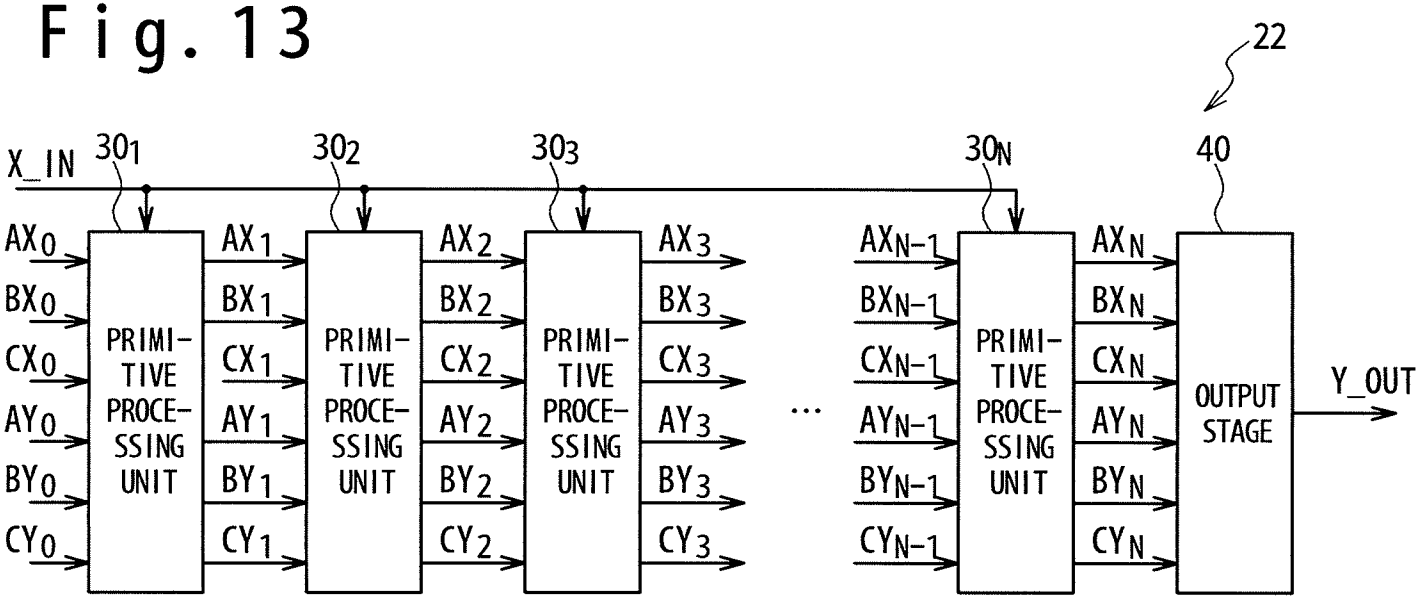
FIG. 13 is a block diagram illustrating one example of the configuration of a Bezier curve calculation circuitry according to one or more embodiments.

Since the output value Y_OUT is calculated through repeated midpoint calculations as described above, the Bezier curve calculation circuitry 22 may be configured as a plurality of serially-connected processing circuitries each configured to perform the midpoint calculation. FIG. 13 is a block diagram illustrating one example of the configuration of the Bezier curve calculation circuitry 22 thus configured.

The Bezier curve calculation circuitry 22 includes N primitive processing units $\mathbf{30}_1$ to $\mathbf{30}_N$ and an output stage 40. Each of the primitive processing units $\mathbf{30}_1$ to $\mathbf{30}_N$ is configured to perform the above-described midpoint calculation. In other words, the primitive processing unit $\mathbf{30}_i$ is configured to calculate the X and Y coordinates of the control points $A_i$, $B_i$ and $C_i$ from the X and Y coordinates of the control points $A_{i-1}$, $B_{i-1}$ and $C_{i-1}$ through calculations in accordance with expressions (8a) to (13a) and (8b) to (13b), where i is an integer from one to N. The output stage 40 outputs the output value Y_OUT on the basis of the Y coordinate of at least one control point selected from the control points $A_N$, $B_N$ and $C_N$, which is output from the primitive processing unit $\mathbf{30}_N$ (that is, on the basis of at least one of $AY_N$, $BY_N$ and $CY_N$). The output stage 40 may output the Y coordinate of a selected one of the control points $A_N$, $B_N$ and $C_N$ as the output value Y_OUT.

Figure 14:
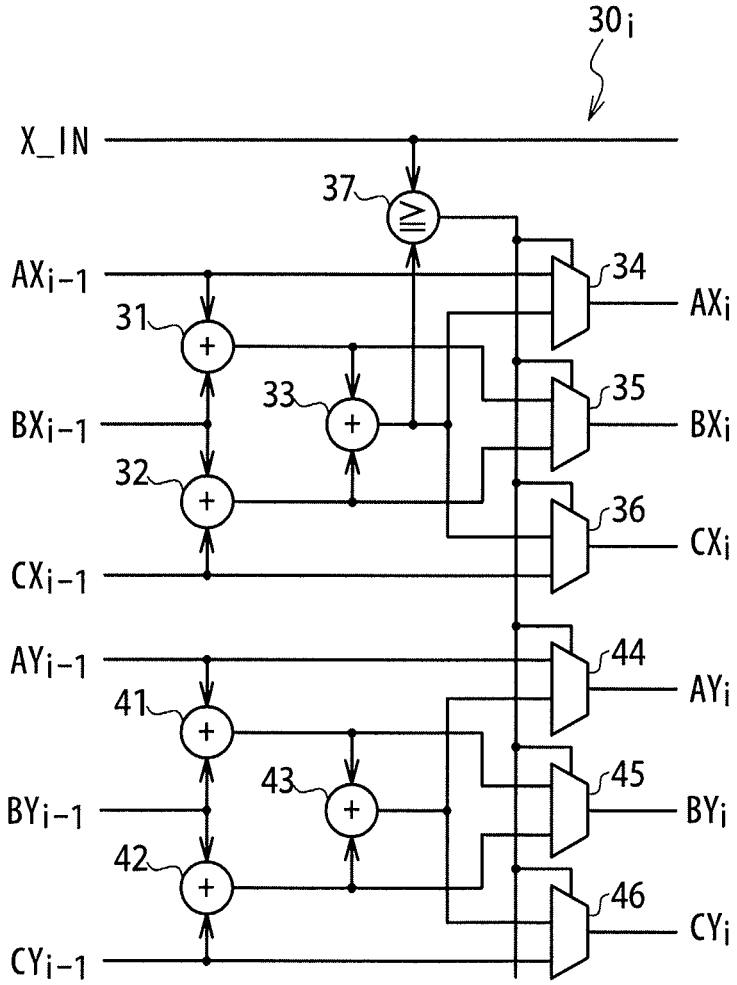
FIG. 14 is a circuit diagram illustrating the configuration of the processing units of the Bezier curve calculation circuitry according to one or more embodiments.

FIG. 14 is a circuit diagram illustrating the configuration of each primitive processing unit $\mathbf{30}_i$. Each primitive processing unit 30 includes adders 31 to 33, selectors 34 to 36, a comparator 37, adders 41 to 43, and selectors 44 to 46. The adders 31 to 33 and the selectors 34 to 36 perform calculations on the X coordinates of the control points $A_{i-1}$, $B_{i-1}$, and $C_{i-1}$ and the adders 41 to 43 and the selectors 44 to 46 perform calculations on the Y coordinates of the control points $A_{i-1}$, $B_{i-1}$, and $C_{i-1}$.

In one embodiment, each primitive processing unit $\mathbf{30}_i$ includes seven input terminals. One of the seven input terminal receives the input grayscale value X_IN, and the remaining six receive the X coordinates $AX_{i-1}$, $BX_{i-1}$ and $CX_{i-1}$ and Y coordinates $AY_{i-1}$, $BY_{i-1}$ and $CY_{i-1}$ of the control points $A_{i-1}$, $B_{i-1}$ and $C_{i-1}$, respectively. The adder 31 has a first input connected to the input terminal to which $AX_{i-1}$ is supplied and a second input connected to the input terminal to which $BX_{i-1}$ is supplied. The adder 32 has a first input connected to the input terminal to which $BX_{i-1}$ is supplied and a second input connected to the input terminal to which $CX_{i-1}$ is supplied. The adder 33 has a first input connected to the output of the adder 31 and a second input connected to the output of the adder 32.

Similarly, the adder 41 has a first input connected to the input terminal to which $AY_{i-1}$ is supplied and a second input connected to the input terminal to which $BY_{i-1}$ is supplied. The adder 42 has a first input connected to the input terminal to which $BY_{i-1}$ is supplied and a second input connected to the input terminal to which $CY_{i-1}$ is supplied. The adder 43 has a first input connected to the output of the adder 41 and a second input connected to the output of the adder 42.

The comparator 37 has a first input to which the input gray-level value X_IN is supplied and a second input connected to the output of the adder 33.

The selector 34 has a first input connected to the input terminal to which $AX_{i-1}$ is supplied and a second input connected to the output of the adder 33, and selects the first or second input in response to the output value of the comparator 37. The output of the selector 34 is connected to the output terminal from which $AX_i$ is output. Similarly, the selector 35 has a first input connected to the output of the adder 31 and a second input connected to the output of the adder 32, and selects the first or second input in response to the output value of the comparator 37. The output of the selector 35 is connected to the output terminal from which $BX_i$ is output. Furthermore, the selector 36 has a first input connected to the output of the adder 33 and a second input connected to the input terminal to which $C_{i-1}$ is supplied, and selects the first or second input in response to the output value of the comparator 37. The output of the selector 36 is connected to the output terminal from which $CX_i$ is output.

In one embodiment, the selector 44 has a first input connected to the input terminal to which $AY_{i-1}$ is supplied and a second input connected to the output of the adder 43, and selects the first or second input in response to an output value of the comparator 37. The output of the selector 44 is connected to the output terminal from $AY_i$ is output. Similarly, the selector 45 has a first input connected to the output of the adder 41 and a second input connected to the output of the adder 42, and selects the first or second input in response to the output value of the comparator 37. The output of the selector 45 is connected to the output terminal from which $BY_i$ is output. Furthermore, the selector 46 has a first input connected to the output of the adder 43 and a second input connected to the input terminal to which $CY_{i-1}$ is supplied, and selects the first or second input in response to the output value of the comparator 37. The output of the selector 46 is connected to the output terminal from which $CY_i$ is output.

In the primitive processing unit $\mathbf{30}_i$ thus configured, the adder 31 performs the calculation in accordance with the above-described expression (9a), the adder 32 performs the calculation in accordance with the above-described expression (9b), and the adder 33 performs the calculation in accordance with (10a) and (8b) using the output values from the adders 31 and 32. Similarly, the adder 41 performs the calculation in accordance with the above-described expression (12a), the adder 42 performs the calculation in accordance with the expression (12b), and the adder 43 performs the calculation in accordance with expressions (13a) and (11b) using the output values from the adders 41 and 42. The comparator 37 compares the output value of the adder 33 with the input grayscale value X_IN, and indicates which of the two input values supplied to each of the selectors 34 to 36 and 44 to 46 is to be output as the output value. When the input grayscale value X_IN is smaller than $(AX_{i-1}+2BX_{i-1}+CX_{i-1})/4$, the selector 34 selects $AX_{i-1}$, the selector 35 selects the output value of the adder 31, the selector 36 selects the output value of the adder 33, the selector 44 selects $AY_{i-1}$, the selector 45 selects the output value of the adder 41, and the selector 46 selects the output value of the adder 43. When the input gray-level value X_IN is larger than $(AX_{i-1}+2BX_{i-1}+CX_{i-1})/4$, the selector 34 selects the output value of the adder 33, the selector 35 selects the output value of the adder 32, the selector 36 selects the $CX_{i-1}$, the selector 44 selects the output value of the adder 43, the selector 45 selects the output value of the adder 42, and the selector 46 selects $CY_{i-1}$. The values selected by the selectors 34 to 36 and 44 to 46 are supplied to the primitive processing unit of the following stage as $AX_i$, $BX_i$, $CX_i$, $AY_i$, $BY_i$, and $CY_i$, respectively.

In various embodiments the divisions described within expressions (8a) to (13a) and (8b) to (13b) can be realized by truncating lower bits. Most simply, desired calculations can be achieved by truncating lower bits of the outputs of the adders 31 to 33 and 41 to 43. In this case, one bit may be truncated from each of the output terminals of the adders 31 to 33 and 41 to 43. It should be noted however that the positions where the lower bits are truncated in the circuitry may be arbitrarily modified as long as calculations equivalent to the expressions (8a) to (13a) and (8b) to (13b) are achieved. For example, lower bits may be truncated at the input terminals of the adders 31 to 33 and 41 to 43 or on the input terminals of the comparator 37, the selectors 34 to 36 and the selectors 44 to 46.

The output value Y_OUT is finally obtained from at least one of $AY_N$, $BY_N$ and $CY_N$ output from the primitive processing unit $\mathbf{30}_N$, which is the final stage of the serially-connected primitive processing units $\mathbf{30}_1$ to $\mathbf{30}_N$ thus configured.

Figure 15:
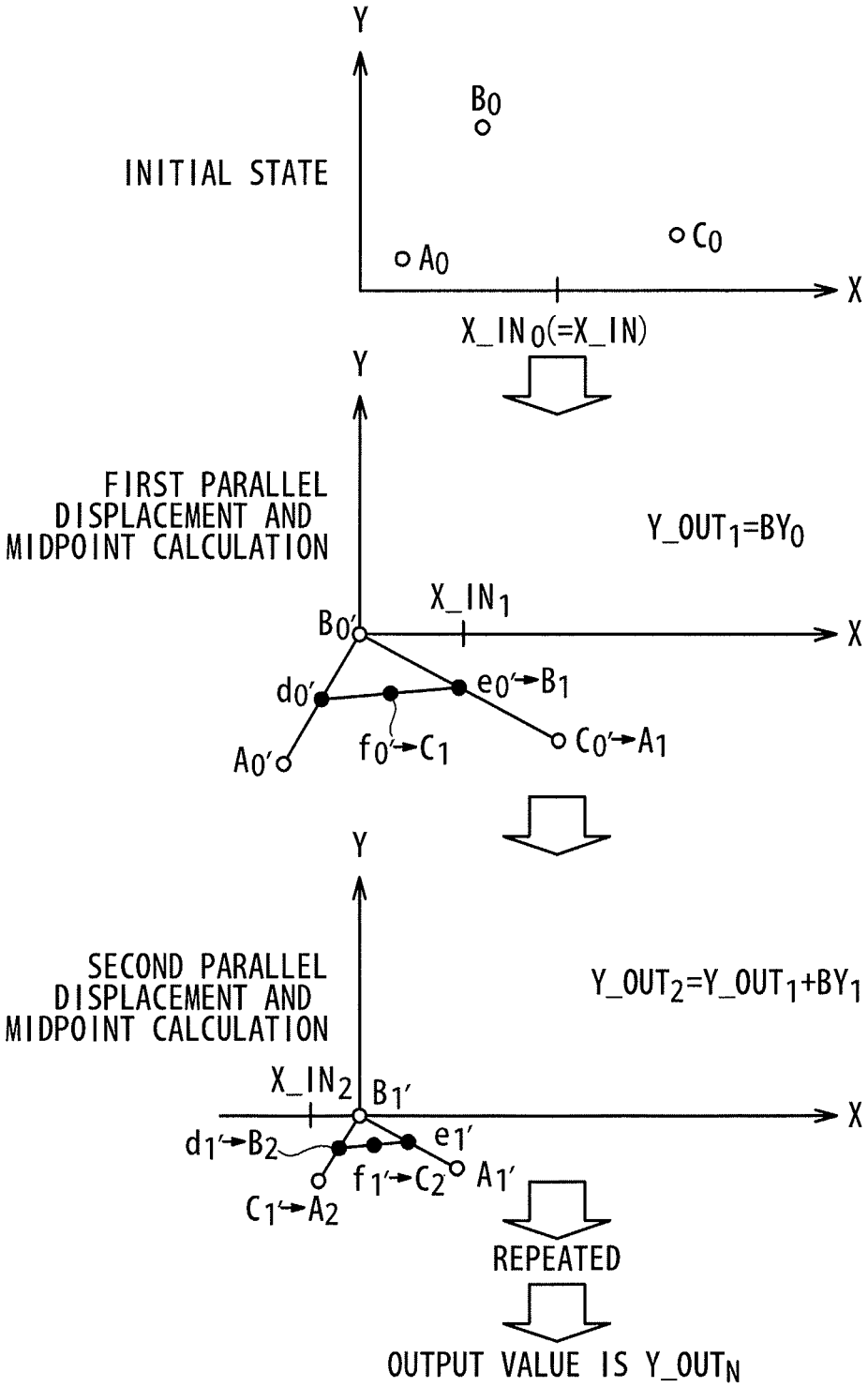
FIG. 15 illustrates a Bezier curve calculation circuitry according to one or more embodiments.

FIG. 15 schematically illustrates an improved algorithm for calculating the output value Y_OUT when a second degree Bezier curve is used for calculating the output value Y_OUT. In the algorithm illustrated in FIG. 15, $i^{th}$ midpoint calculation involves calculating the first order midpoints $d_{i-1}$, $e_{i-1}$ and the second order midpoint $f_{i-1}$ after the control points $A_{i-1}$, $B_{i-1}$ and $C_{i-1}$ are subjected to parallel displacement so that the point $B_{i-1}$ is shifted to the origin. Additionally, the second order midpoint $f_{i-1}$ is always selected as the point $C_i$ used in the $(i+1)^{th}$ midpoint calculation. The repetition of such parallel displacement and midpoint calculation effectively reduces the number of required processing units and the number of bits of the values processed by the respective processing units.

With reference to FIG. 15, in the first parallel displacement and midpoint calculation, the control points $A_O$, $B_O$ and $C_O$ are subjected to parallel displacement so that the control point $B_O$ is shifted to the origin. The control points $A_O$, $B_O$ and $C_O$ after the parallel displacement are referred to as the control points $A_O'$, $B_O'$ and $C_O'$, respectively. The control point $B_O'$ coincides with the origin. Here, the coordinates of the control points $A_0'$ and $C_0'$ are represented as follows, respectively:

$$A_O'(AX_O',AY_O')=(AX_O-BX_O,AY_O-BY_O), \text{ and}$$

$$C_O'(CX_O',CY_O')=(CX_O-BX_O,CY_O-BY_O)$$

Meanwhile, the parallel displacement distance $BX_O$ in the X axis direction is subtracted from an initial processing target grayscale value $X_IN_O$ to obtain a processing target grayscale value $X_IN_1$, where the initial processing target grayscale value $X_IN_O$ is equal to the input grayscale value X_IN.

Next, the first order midpoint $d_O'$ of the control points $A_O'$ and $B_O'$ and the first order midpoint $e_O'$ of the control points $B_O$' and $C_O$' are calculated, and the second order midpoint $f_O'$ of the first order midpoints $e_O'$ and $f_O'$ is further calculated. The second order midpoint $f_O'$ is positioned on the second degree Bezier curve obtained by such parallel displacement that the control point $B_0$ is shifted to the origin (that is, the second degree Bezier curve defined with the three control points $A_O'$, $B_O'$ and $C_O'$).

In this case, the coordinates $(X_{fO}', Y_{fO}')$ of the second order midpoint $f_O'$ are represented by the following expression:

$$(X_{f0}', Y_{f0}') = \left(\frac{AX_0' + CX_0'}{4}, \frac{AY_0' + CY_0'}{4}\right), \tag{14}$$

-continued $$= \left( \frac{(AX_0 - BX_0) + (CX_0 - BX_0)}{4}, \frac{(AY_0 - BY_0) + (CY_0 - BY_0)}{4} \right)$$

$$= \left( \frac{AX_0 - 2BX_0 + CX_0}{4}, \frac{AY_0 - 2BY_0 + CY_0}{4} \right)$$

The three control points $A_1$, $B_1$ and $C_1$ used in next parallel displacement and midpoint calculation (the second parallel displacement and midpoint calculation) are selected from among the point $A_O'$, the first order midpoint $d_O'$, the second order midpoint $f_O'$, the first order midpoint $e_O'$ and the point $C_O'$ in response to the result of comparison of the processing target grayscale value $X_IN_1$ with the X coordinate value $X_{fO}'$ of the second order midpoint $f_O'$. In this selection, the second order midpoint $f_O'$ is always selected as the control point $C_1$ whereas the control points $A_1$ and $B_1$ are selected as follows:

When $X_{fo}' \geq X_IN_1$ (A)

In this case, the two points having the smallest two X coordinates (the leftmost two points), that is, the control point $A_O'$ and the first order midpoint $d_O'$ are selected as the control points $A_1$ and $B_1$, respectively. In other words, $$A_1 = A_O', B_1 = d_O' \text{ and } C_1 = f_O'. \quad (15a)$$

When $X_{fO} < X_IN_1$ (B)

In this case, the two points having the largest two X coordinates (the rightmost two points), that is, the control point $C_O'$ and the first order midpoint $e_O'$ are selected as the control points $A_1$ and $B_1$, respectively. In other words, $$A_1 = C_O', B_1 = e_O' \text{ and } C_1 = f_O'. \quad (15b)$$

As a whole, in the first parallel displacement and midpoint calculation, the following calculations are performed:

$$X_IN_1 = X_IN_0 - BX_0, \text{ and} \quad (16)$$

$$X_{f0}' = (AX_0 - 2BX_0 + CX_0)/4. \quad (17)$$

When $X_{fO}' \geq X_IN_1$, (A)

$$AX_1 = AX_0 - BX_0, \quad (17a)$$

$$BX_1 = (AX_0 - BX_0)/2, \quad (18a)$$

$$CX_1 = X_{f0}' = (AX_0 - 2BX_0 + CX_0)/4, \quad (19)$$

$$AY_1 = AY_0 - BY_0, \quad (20a)$$

$$BY_1 = (AY_0 - BY_0)/2, \text{ and} \quad (21a)$$

$$CY_1 = Y_{f0}' = (AY_0 - 2BY_0 + CY_0)/4. \quad (22)$$

When $X_{fO}' < X_IN_1$, (B)

$$AX_1 = CX_0 - BX_0, \quad (17b)$$

$$BX_1 = (CX_0 - BX_0)/2, \quad (18b)$$

$$CX_1 = (AY_0 - 2BY_0 + CY_0)/4, \quad (19)$$

$$AY_1 = CY_0 - BY_0, \quad (20b)$$

$$BY_1 = (CY_0 - BY_0)/2, \text{ and} \quad (21b)$$

$$CY_1 = (AY_0 - 2BY_0 + CY_0)/4. \quad (22)$$

It would be apparent to a person skilled in the art that the equal sign may be attached to any one of the inequality signs recited in conditions (A) and (B).

As understood from expressions (17a), (18a), (17b) and (18b), the following relationship may be established irrespectively of which of conditions (A) and (B) is satisfied:

$$AX_1 = 2BX_1, \text{ and} \quad (23)$$

$$AY_1 = 2BY_1. \quad (24)$$

This implies that there is no need to redundantly calculate or store the coordinates of the control points $A_1$ and $B_1$ when the above-described processing is actually implemented. This would be understood from the fact that the control point $B_1$ is located at the midpoint between the control point $A_1$ and the origin O as illustrated in FIG. 15. Although a description is given below of an embodiment in which the coordinates of the control point $B_1$ are calculated, the calculation of the coordinates of the control point $A_1$ is substantially equivalent to that of the coordinates of the control point $B_1$.

Similar processing is performed in the second parallel displacement and midpoint calculation. First, the control points $A_1$, $B_1$ and $C_1$ are subjected to such a parallel displacement that the control point $B_1$ is shifted to the origin. The control points $A_1$, $B_1$ and $C_1$ after the parallel displacement are referred to as the control points $A_1'$, $B_1'$ and $C_1'$, respectively. Additionally, the parallel displacement distance $BX_1$ in the X axis direction is subtracted from the processing target grayscale value $X_IN_1$, thereby calculating the processing target grayscale value $X_IN_2$. Next, the first order midpoint $d_1'$ of the control points $A_1'$ and $B_1'$ and the first order midpoint $e_1'$ of the control points $B_1'$ and $C_1'$ are calculated, and the second order midpoint $f_1'$ of the first order midpoints $d_1'$ and $e_1'$ is further calculated.

Similarly to expressions (16) to (22), the following expressions are obtained:

$$X_IN_2 = X_IN_1 - BX_1, \text{ and} \quad (25)$$

$$X_{f1}' = (AX_1 - 2BX_1 + CX_1)/4. \quad (26)$$

When $X_{f1}' \geq X_IN_2$, (A)

$$AX_2 = AX_1 - BX_1, \quad (27a)$$

$$BX_2 = (AX_1 - BX_1)/2, \quad (28a)$$

$$CX_2 = X_{f1}', = (AX_1 - 2BX_1 + CX_1)/4, \quad (29)$$

$$AY_2 = AY_1 - BY_1, \quad (30a)$$

$$BY_2 = (AY_1 - BY_1)/2, \text{ and} \quad (31a)$$

$$CY_2 = Y_{f1}', \text{ and} = (AY_1 - 2BY_1 + CY_1)/4. \quad (32)$$

When $X_{f1}' < X_IN_2$, (B)

$$AX_2 = CX_1 - BX_1, \quad (27b)$$

$$BX_2 = (CX_1 - BX_1)/2, \quad (28b)$$

$$CX_2 = (AY_1 - 2BY_1 + CY_1)/4, \quad (29)$$

$$AY_2=CY_1-BY_1, \quad (30b)$$

$$BY_2=(CY_1-BY_1)/2, \text{ and} \quad (31b)$$

$$CY_2=(AY_1-2BY_1+CY_1)/4. \quad (32)$$

Here, by substituting expression (23) into expressions (28a) and (29) and expression (24) into expressions (31a) and (32), the following expressions are obtained:

$$BX_2 = BX_1/2, (\text{for } CX_1 \geq \text{X_IN}_2) \quad (33a)$$

$$= (CX_1 - BX_1)/2, (\text{for } CX_1 < \text{X_IN}_2) \quad (33b)$$

$$CX_2 = CX_1/4, \quad (34)$$

$$BY_2 = BY_1/2, (\text{for } CX_1 \geq \text{X_IN}_2) \quad (35a)$$

$$= (CY_1 - BY_1)/2, (\text{for } CX_1 < \text{X_IN}_2) \text{ and} \quad (35b)$$

$$CY_2 = CY_1/4. \quad (36)$$

It should be noted that in some embodiments, there may be no need to redundantly calculate or store the X coordinate $AX_2$ and the Y coordinate $AY_2$ of the control point $A_2$, since the following relationship is established as is the case of expressions (23) and (24):

$$AX_2=2BX_2, \text{ and} \quad (37)$$

$$AY_2=2BY_2. \quad (38)$$

Similar processing is performed in the third and subsequent parallel displacements and midpoint calculations. It would be understood that, similarly to the second parallel displacement and midpoint calculation, the processing performed in the $i^{th}$ parallel displacement and midpoint calculation (for i≥2) is represented by the following expressions:

$$\text{X_IN}_i = \text{X_IN}_{i-1} - BX_{i-1}, \quad (39)$$

$$BX_i = BX_{i-1}/2, (\text{for } CX_{i-1} \geq \text{X_IN}_i) \quad (40a)$$

$$= (CX_{i-1} - BX_{i-1})/2, (\text{for } CX_{i-1} < \text{X_IN}_i) \quad (40b)$$

$$CX_i = CX_{i-1}/4 \quad (41)$$

$$BY_i = BY_{i-1}/2, (\text{for } CX_{i-1} \geq \text{X_IN}_i) \quad (42a)$$

$$= (CY_{i-1} - BY_{i-1})/2, (\text{for } CX_{i-1} < \text{X_IN}_i) \text{ and} \quad (42b)$$

$$CY_i = CY_{i-1}/4. \quad (43)$$

It would be apparent to a person skilled in the art that the equal sign may be attached to any one of the inequality signs recited in expressions (40a) and (40b) The same goes for expressions (42a) and (42b).

Expressions (41) and (43) imply that the control point $C_i$ is positioned on the segment connecting the origin O to the control point $C_{i-1}$ and that the distance between the control point $C_i$ and the origin O is a quarter of the length of the segment $OC_{i-1}$. Accordingly, the repetition of the parallel displacement and midpoint calculation makes the control point $C_i$ closer to the origin O. It would be readily understood that this relationship allows simplification of the calculation of coordinates of the control point $C_1$. It should be also noted that, in various embodiments, there may be no need to calculate or store the coordinates of the points $A_2$ to $A_N$ in the second and following parallel displacements and midpoint calculations similarly to the first parallel displacement and midpoint calculation, since expressions (39) to (43) do not recite the coordinates of the control points $A_1$ and $A_{i-1}$.

The output value Y_OUT to be finally calculated by repeating the parallel displacement and midpoint calculation N times is obtained as the Y coordinate value of the control point $B_N$ with all the parallel displacements cancelled. Accordingly, the output coordinate value Y_OUT can be calculated the following expression:

$$\text{Y_OUT}=BY_0+BY_1+ \ldots +BY_{i-1}. \quad (44)$$

To achieve such processing, the following processing is performed in the $i^{th}$ parallel displacement and midpoint calculation:

$$\text{Y_OUT}_1=BY_0, (\text{for } i=1) \text{ and}$$

$$\text{Y_OUT}_i=\text{Y_OUT}_{i-1}+BY_{i-1}. (\text{for } i\geq 2) \quad (45)$$

In this case, the output value Y_OUT of interest is obtained as $\text{Y_OUT}_N$.

Figure 16:
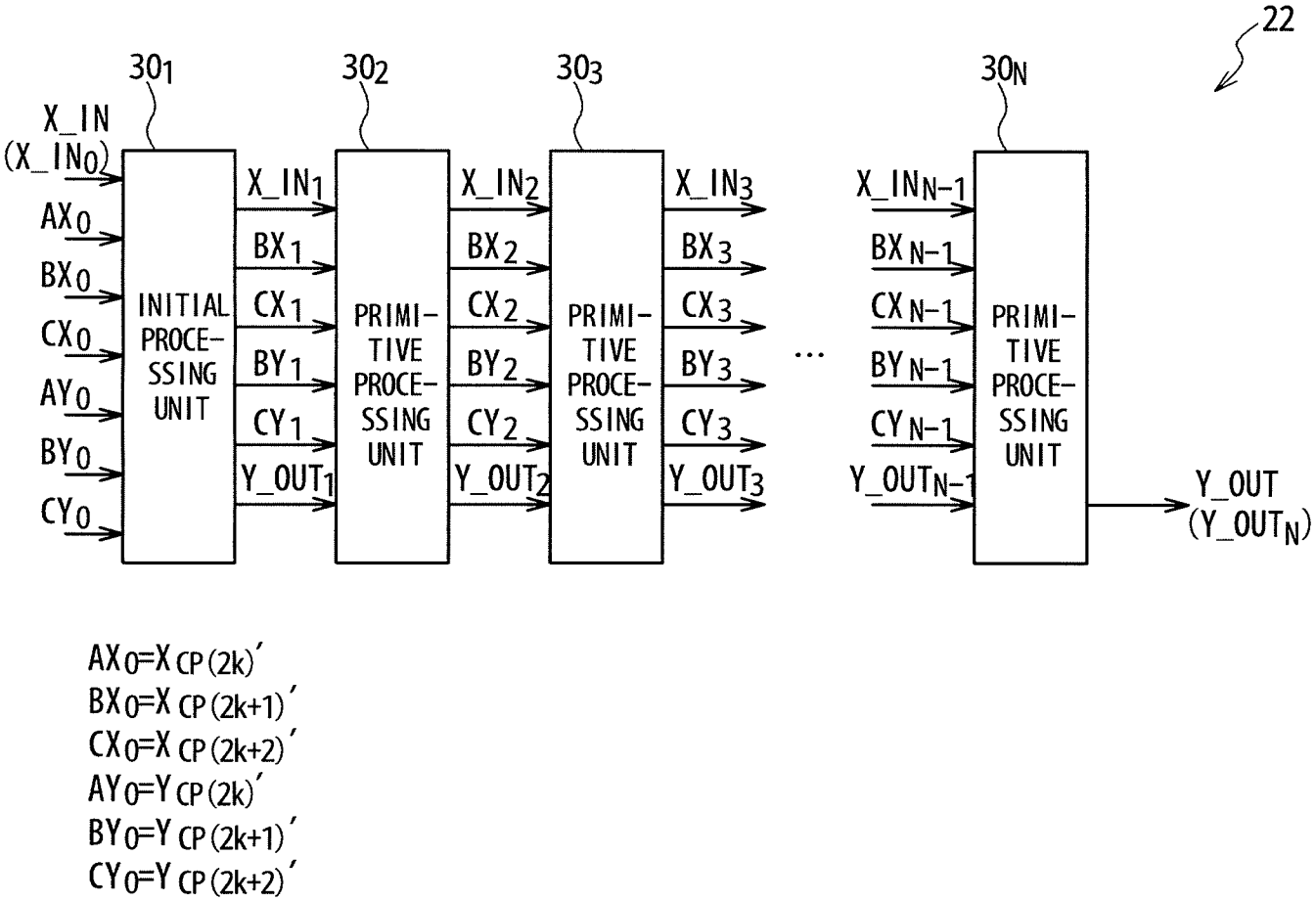
FIG. 16 is a block diagram illustrating an example configuration of a Bezier curve calculation circuitry according to one or more embodiments.

FIG. 16 is a circuit diagram illustrating the configuration of the Bezier curve calculation circuitry 22 in which the parallel displacement and midpoint calculation. The Bezier curve calculation circuitry 22 illustrated in FIG. 16 includes an initial-stage processing unit $\mathbf{50}_1$ and a plurality of primitive processing units $\mathbf{50}_2$ to $\mathbf{50}_N$ serially connected to the output of the initial-stage processing unit $\mathbf{50}_1$. The initial-stage processing unit $\mathbf{50}_1$ has the function of achieving the first parallel displacement and midpoint calculation and is configured to perform the calculations in accordance with expressions (16) to (22). The primitive processing units $\mathbf{50}_2$ to $\mathbf{50}_N$ have the function of achieving the second and following parallel displacements and midpoint calculations and are configured to perform the calculations in accordance with expressions (39) to (43) and (45).

Figure 17:
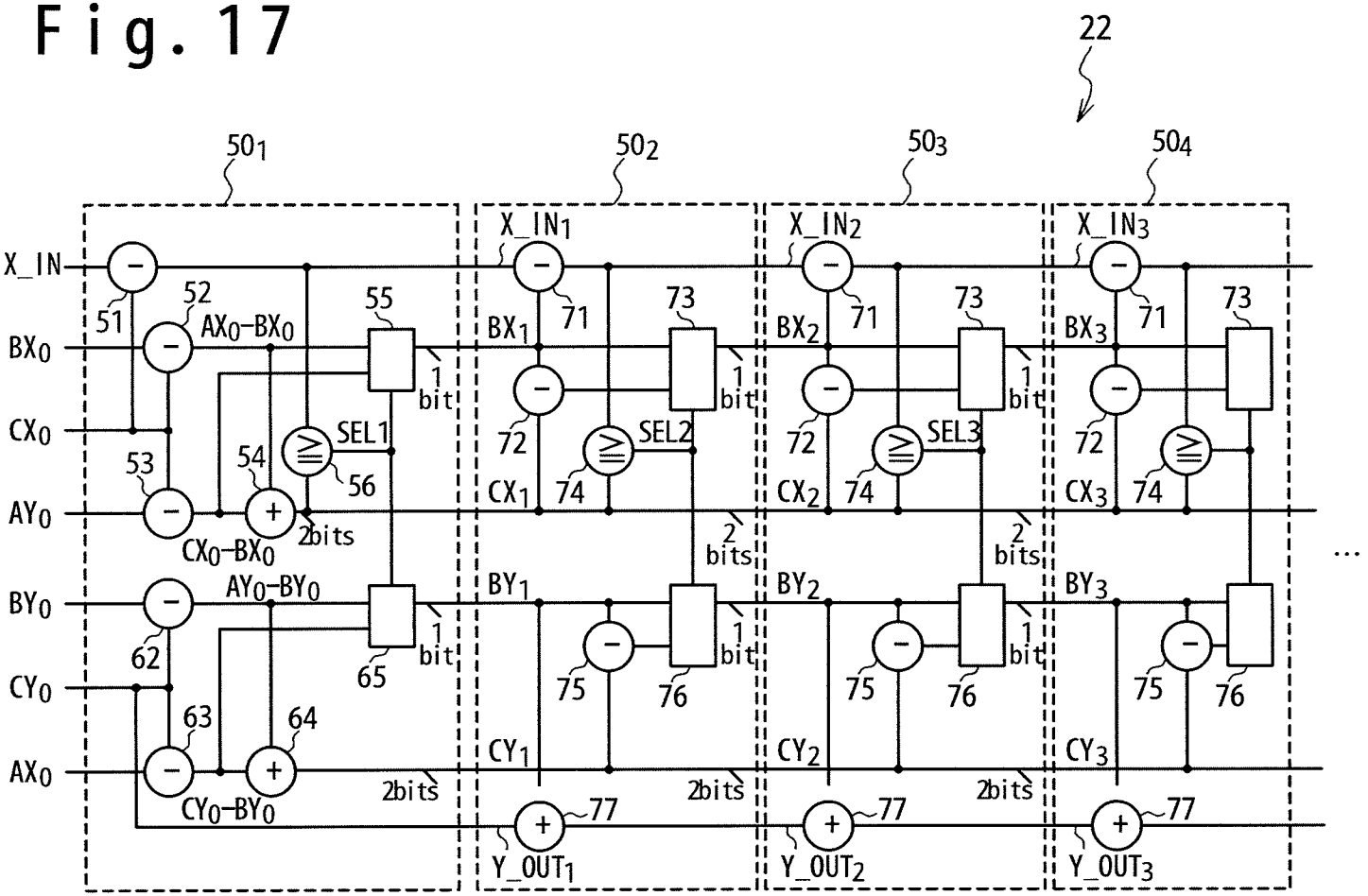
FIG. 17 is a circuit diagram illustrating configurations of an initial-stage processing unit and processing units of the Bezier curve calculation circuitry according to one or more embodiments.

FIG. 17 is a circuit diagram illustrating the configurations of the initial-stage processing unit $\mathbf{50}_1$ and the primitive processing units $\mathbf{50}_2$ to $\mathbf{50}_N$. The initial-stage processing unit $\mathbf{50}_1$ includes subtractors 51 to 53, an adder 54, a selector 55, a comparator 56, subtractors 62 and 63, an adder 64, and a selector 65. The initial-stage processing unit $\mathbf{50}_1$ has seven input terminals. The input grayscale value X_IN is inputted to one of the input terminals, and the X coordinates $AX_O$, $BX_O$ and $CX_O$ and Y coordinates $AY_O$, $BY_O$, and $CY_O$ of the control points $A_O$, $B_O$ and $C_O$ are supplied to the other six terminals, respectively.

The subtracter 51 has a first input to which the input grayscale value X_IN is supplied and a second input connected to the input terminal to which $BX_O$ is supplied. The subtracter 52 has a first input connected to the input terminal to which $AX_O$ is supplied and a second input connected to the input terminal to which $BX_O$ is supplied. The subtracter 53 has a first input connected to the input terminal to which $CX_O$ is supplied and a second input connected to the input terminal to which $BX_O$ is supplied. The adder 54 has a first input connected to the output of the subtracter 52 and a second input connected to the output of the subtracter 53.

Similarly, the subtracter 62 has a first input connected to the input terminal to which $AY_O$ is supplied and a second input connected to the input terminal to which $BY_O$ is supplied. The subtracter 63 has a first input connected to the input terminal to which $CY_O$ is supplied and a second input connected to the input terminal to which $BY_O$ is supplied. The adder 64 has a first input connected to the output of the subtracter 62 and a second input connected to the output of the subtracter 63.

The comparator 56 has a first input connected to the output of the subtracter 51 and a second input connected to the output of the adder 54. The selector 55 has a first input connected to the output of the subtracter 52 and a second input connected to the output of the subtracter 53, and selects the first or second input in response to the output value SEL1 of the comparator 56. Furthermore, the selector 65 has a first input connected to the subtracter 62 and a second input connected to the output of the subtracter 63, and selects the first or second input in response to the output value SEL1 of the comparator 56.

The output terminal from which the processing target grayscale value $X_IN_1$ is outputted is connected to the output of the subtracter 51. The output terminal from which $BX_1$ is outputted is connected to the output of the selector 55, and the output terminal from which $CX_1$ is outputted is connected to the output of the adder 54. Furthermore, the output terminal from which $BY_1$ is outputted is connected to the output of the selector 65, and the output terminal thereof from which $CY_1$ is outputted is connected to the output of the adder 64.

The subtracter 51 performs the calculation in accordance with expression (16), and the subtracter 52 performs the calculation in accordance with expression (18a). The subtracter 53 performs the calculation in accordance with expression (18b), and the adder 54 performs the calculation in accordance with expression (19) on the basis of the output values of the subtractors 52 and 53. Similarly, the subtracter 62 performs the calculation in accordance with expression (21a). The subtracter 63 performs the calculation in accordance with expression (21b), and the adder 64 performs the calculation in accordance with expression (22) on the basis of the output values of the subtractors 62 and 63. The comparator 56 compares the output value of the subtracter 51 (that is, $X_IN_O-BX_O$) with the output value of the adder 54, and instructs the selectors 55 and 65 to select which of the two input values thereof is to be outputted as the output value. In various embodiments, when $X_IN_1$ is equal to or smaller than $(AX_O-2BX_O+CX_O)/4$, the selector 55 selects the output value of the subtracter 52 and the selector 65 selects the output value of the subtracter 62. Further, when $X_IN_O-BX_O$ is larger than $(AX_O-2BX_O+CX_O)/4$, the selector 55 selects the output value of the subtracter 53 and the selector 65 selects the output value of the subtracter 63. The values selected by the selectors 55 and 65 are supplied to the primitive processing unit $\mathbf{50}_2$ as $BX_1$ and $BY_1$, respectively. Furthermore, the output values of the adders 54 and 64 are supplied to the primitive processing unit $\mathbf{50}_2$ as $CX_1$ and $CY_1$, respectively.

It should be noted, that in various embodiments, that divisions recited in expressions (16) to (22) can be realized by truncating lower bits. The positions where the lower bits are truncated in the circuit may be arbitrarily modified as long as calculations equivalent to expressions (16) to (22) are performed. The initial-stage processing unit $\mathbf{50}_1$ illustrated in FIG. 17 is configured to truncate the lowest one bit on the outputs of the selectors 55 and 65 and to truncate the lowest two bits on the outputs of the adders 54 and 64.

Meanwhile, the primitive processing units $\mathbf{50}_2$ to $\mathbf{50}_N$, which have the same configuration, each include subtractors 71 and 72, a selector 73, a comparator 74, a subtracter 75, a selector 76, and an adder 77.

In the following, a description is given of the primitive processing unit $\mathbf{50}_i$ which performs the $i^{th}$ parallel displacement and midpoint calculation, where i is an integer from two to N. The subtracter 71 has a first input connected to the input terminal to which the processing target grayscale value $X_IN_{i-1}$ is supplied, and a second input connected to the input terminal to which $BX_{i-1}$ is supplied. The subtracter 72 has a first input connected to the input terminal to which $BX_{i-1}$ is supplied, and a second input connected to the input terminal to which $CX_{i-1}$ is supplied. The subtracter 75 has a first input connected to the input terminal to which $BY_{i-1}$ is supplied, and a second input connected to the input terminal to which $CY_{i-1}$ is supplied.

The comparator 74 has a first input connected to the output of the subtracter 71 and a second input connected to the input terminal to which $CX_{i-1}$ is supplied.

The selector 73 has a first input connected to the input terminal to which $BX_{i-1}$ is supplied, and a second input connected to the output of the subtracter 72, and selects the first or second input in response to the output value SELi of the comparator 74. Similarly, the selector 76 has a first input connected to the input terminal to which $BY_{i-1}$ is supplied, and a second input connected to the output of the subtracter 75, and selects the first or second input in response to the output value of the comparator 74.

The processing target grayscale value $X_IN_i$ is output from the output terminal connected to the output of the subtracter 71. $BX_i$ is output from the output terminal connected to the output of the selector 73, and $CX_i$ is output from the output terminal connected to the input terminal to which $CX_i$ is supplied via an interconnection. In this process, the lower two bits of $CX_i$ are truncated. Furthermore, $BY_i$ is output from the output terminal connected to the output of the selector 73, and $CY_i$ is output from the output terminal connected to the input terminal to which $CY_{i-1}$ is supplied via an interconnection. In this process, the lower two bits of $CY_{i-1}$ are truncated.

The adder 77 has a first input connected to the input terminal to which $BX_{i-1}$ is supplied, and a second input connected to the input terminal to which $Y_OUT_{i-1}$ is supplied. It should be noted that, with respect to the primitive processing unit $\mathbf{50}_2$ which performs the second parallel displacement and midpoint calculation, $Y_OUT_1$ supplied to the primitive processing unit $\mathbf{50}_2$ coincides with $BY_O$. $Y_OUT_i$ is outputted from the output of the adder 77.

The subtracter 71 performs the calculation in accordance with expression (39), and the subtracter 72 performs the calculation in accordance with expression (40b). The subtracter 75 performs the calculation in accordance with expression (42b), and the adder 77 performs the calculation in accordance with expression (45). The comparator 74 compares the output value $X_IN_i(=X_IN_{i-1}-BX_{i-1})$ of the subtracter 71 with $CX_{i-1}$, and instructs the selectors 73 and 76 to select which of the two input values thereof is to be outputted as the output value. When $X_IN_i$ is equal to or smaller than $CX_{i-1}$, the selector 73 selects $BX_{i-1}$ and the selector 76 selects $BY_{i-1}$. When $X_IN_i$ is larger than $CX_{i-1}$, on the other hand, the selector 73 selects the output value of the subtracter 72 and the selector 76 selects the output value of the subtracter 75. The values selected by the selectors 73 and 76 are supplied to the next primitive processing unit $\mathbf{50}_{i+1}$ as $BX_i$ and $BY_i$, respectively. Furthermore, the values obtained by truncating the lower two bits of $CX_{i-1}$ and $CY_{i-1}$ are supplied to the next primitive processing unit $\mathbf{50}_{i+1}$ as $CX_i$ and $CY_i$, respectively.

It should be noted here that divisions recited in expressions (40) to (43) can be realized by truncating lower bits. The positions where the lower bits are truncated in the circuit may be arbitrarily modified as long as operations equivalent to Equations (40) to (43) are performed. The primitive processing unit $\mathbf{50}_i$ illustrated in FIG. 17 is configured to truncate the lower one bit on the outputs of the selectors 73 and 76 and to truncate the lower two bits on the interconnections receiving $CX_{i-1}$ and $CY_{i-1}$.

The effect of reduction in the number of the processing elements would be understood from the comparison of the configuration of the primitive processing units $\mathbf{50}_2$ to $\mathbf{50}_N$ illustrated in FIG. 17 with that of the primitive processing units $\mathbf{30}_1$ to $\mathbf{30}_N$ illustrated in FIG. 14. Besides, in the configuration adapted to the parallel displacement and midpoint calculation illustrated in FIG. 17, in which each of the primitive processing units $\mathbf{50}_2$ to $\mathbf{50}_N$ is configured to truncate lower bits, the number of bits of data to be handled is more reduced in latter ones of the primitive processing units $\mathbf{50}_2$ to $\mathbf{50}_N$. As thus discussed, the configuration adapted to the parallel displacement and midpoint calculation as illustrated in FIG. 17 allows calculating the output value Y_OUT with reduced hardware utilization.

Although the above-described embodiments recite the cases where the output value Y_OUT is calculated using the second degree Bezier curve having the shape specified by three control points, in other embodiments, the output value Y_OUT may be alternatively calculated by using a third or higher degree Bezier curve. When an $n^{th}$ degree Bezier curve is used, the X and Y coordinates of (n+1) correction control points are initially given, and similar midpoint calculations are performed on the (n+1) correction control points to calculate the output value Y_OUT.

In various embodiments, when (n+1) correction control points are given, the midpoint calculation is performed as follows. First order midpoints are each calculated as a midpoint of adjacent two of the (n+1) correction control points. The number of the first order midpoints is n. Further, second order midpoints are each calculated as a midpoint of adjacent two of the n first order midpoints. The number of the second order midpoint is n−1. In the same way, (n−k) $(k+1)^{th}$ order midpoints are each calculated as a midpoint of adjacent two of the (n−k+1) $k^{th}$ order midpoints. This procedure is repeatedly carried out until the single n-th order midpoint is finally calculated. Here, the control point having the smallest X coordinate out of the (n+1) correction control points is referred to as the minimum control point and the control point having the largest X coordinate is referred to as the maximum control point. Similarly, the $k^{th}$ order midpoint having the smallest X coordinate out of the $k^{th}$ order midpoints is referred to as the $k^{th}$ order minimum midpoint and the $k^{th}$ order midpoint having the largest X coordinate is referred to as the $k^{th}$ order maximum midpoint. When the X coordinate value of the $n^{th}$ order midpoint is smaller than the input grayscale value X_IN, the minimum control point, the first to $(n-1)^{th}$ order minimum midpoints and the n-th order midpoint are selected as the (n+1) control points for the next midpoint calculation. When the X coordinate of the n-th order midpoint is larger than the input grayscale value X_IN, the $n^{th}$ order midpoint, the first to $(n-1)^{th}$ order maximum midpoints and the maximum control point are selected as the (n+1) control points for the next midpoint calculation. The output value Y_OUT is calculated on the basis of the Y coordinate of at least one of the (n+1) control points obtained through N times of the midpoint calculation.

For easiness of understanding the following describes a midpoint calculation for the case where n=3, that is, the case where a third degree Bezier curve is used to calculate the output value Y_OUT. In this case, four correction control points CP(3k)' to CP(3k+3)' are set to the Bezier curve calculation circuitry 22. In the following, the four correction control points CP(3k)' to CP(3k+3)' are simply referred to control points $A_0$, $B_0$, $C_0$ and $D_0$, and the coordinates of the control points $A_O$, $B_O$, $C_O$, and $D_O$ are referred to as ($AX_O$, $AY_O$), ($BX_O$, $BY_O$), ($CX_O$, $CY_O$), and ($DX_O$, $DY_0$), respectively. The coordinates $A_0$ ($AX_0$, $AY_0$), $B_0$ ($BX_0$, $BY_0$), $C_0$ ($CX_0$, $CY_0$) and $D_0$($DX_0$, $DY_0$) of the control points $A_O$, $B_O$, $C_O$, and $D_O$ are respectively represented as follows:

$$A_0(AX_0,AY_0)=(X_{CP(3k)}',Y_{CP(3k)}'),$$

$$B_0(BX_0,BY_0)=(X_{CP(3k+1)}',Y_{CP(3k+1)}'),$$

$$C_0(CX_0,CY_0)=(X_{CP(3k+2)}',Y_{CP(3k+2)}'), \text{ and}$$

$$D_0(DX_0,DY_0)=(X_{CP(3k+3)}',Y_{CP(3k+3)}').$$

Figure 18:
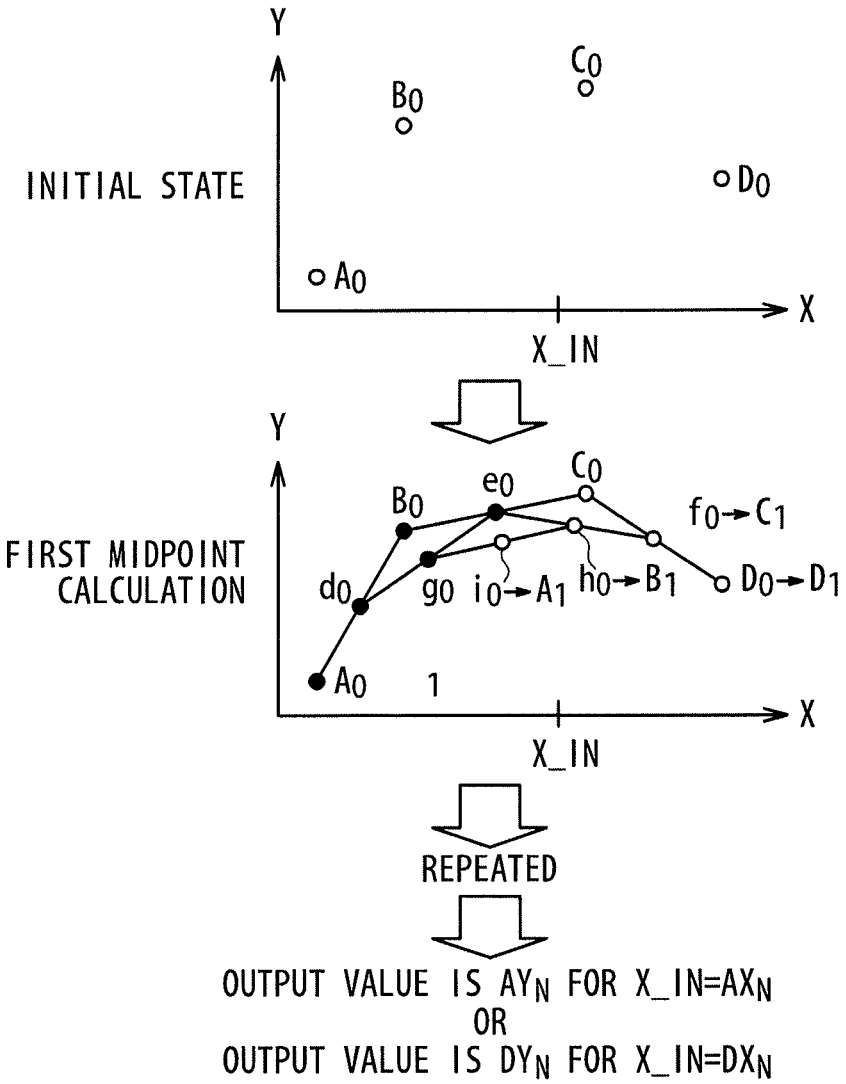
FIG. 18 schematically illustrates a Bezier curve calculation circuitry according to one or more embodiments.

FIG. 18 illustrates the midpoint calculation for n=3 (that is, for the case where the third degree Bezier curve is used to calculate the output value Y_OUT). Initially, four control points $A_O$, $B_O$, $C_O$, and $D_O$ are given. It should be noted that the control point $A_O$ is the minimum control point and the control point $D_O$ is the maximum control point. In the first midpoint calculation, the first order midpoint do that is the midpoint of the control points $A_O$ and $B_O$, the first order midpoint $e_O$ that is the midpoint of the control points $B_O$ and $C_O$, and the first order midpoint $f_O$ that is the midpoint of the control points $C_O$ and $D_O$ are calculated. It should be noted that do is the first order minimum midpoint and that $f_O$ is the first order maximum midpoint. The second order midpoint $g_O$ that is the midpoint of the first order midpoints do and $e_O$ and the second order midpoint $h_O$ that is the midpoint of the first order midpoints $e_O$ and $f_O$ are further calculated. Here, the midpoint $g_O$ is the second order minimum midpoint and $h_O$ is the second order maximum midpoint. Furthermore, the third order midpoint $i_O$ that is the midpoint between the second order midpoints $g_O$ and $h_O$ is calculated. The third order midpoint $i_O$ is a point on the third degree Bezier curve specified by the four control points $A_O$, $B_O$, $C_O$ and $D_O$, and the coordinates ($X_{iO}$, $Y_{iO}$) of the third order midpoint $i_O$ are represented by the following equations, respectively:

$$X_{iO}=(AX_0+3BX_0+3CX_0+DX_0)/8, \text{ and}$$

$$Y_{iO}=(AY_0+3BY_0+3CY_0+DY_0)/8.$$

The four control points $A_1$, $B_1$, $C_1$ and $D_1$ used in the next midpoint calculation (the second midpoint calculation) are selected in response to the result of comparison of the input grayscale value X_IN with the X coordinate $X_{iO}$ of the third order midpoint $i_O$. More specifically, when $X_{iO} \geq$ X_IN, the minimum control point $A_O$, the first order minimum midpoint do, the second order minimum midpoint $f_O$, and the third order midpoint $e_O$ are selected as the control points $A_1$, $B_1$, $C_1$ and $D_1$, respectively. When $X_{iO}<$ X_IN, on the other hand, the third order midpoint $e_O$, the second order maximum midpoint $h_O$, the first order maximum midpoint $f_O$, and the maximum control point $D_O$ are selected as the control points $A_1$, $B_1$, $C_1$ and $D_1$, respectively.

The second and subsequent midpoint calculations are performed by the similar procedure. Generally, the following calculations are performed in the $i^{th}$ midpoint calculation:

$$\text{When } (AX_{i-1}+3BX_{i-1}+3CX_{i-1}+DX_{i-1})/8 \geq X_IN, \tag{A}$$

$$AX_i=AX_{i-1}, \tag{2a'}$$

$$BX_i=(AX_{i-1}+BX_{i-1})/2, \tag{3a'}$$

$$CX_i=(AX_{i-1}+2BX_{i-1}+CX_{i-1})/4, \tag{4a'}$$

$$DX_i=(AX_{i-1}+3BX_{i-1}+3CX_{i-1}+DX_{i-1})/8, \tag{5a'}$$

$$AY_i=AY_{i-1}, \quad (6a')$$

$$BY_i=(AY_{i-1}+BY_{i-1})/2, \quad (7a')$$

$$CY_i=(AY_{i-1}+2BY_{i-1}+CY_{i-1})/4, \text{ and} \quad (8a')$$

$$DY_i=(AY_{i-1}+3BY_{i-1}+3CY_{i-1}+DY_{i-1})/8. \quad (9a')$$

When $(AX_{i-1}+3BX_{i-1}+3CX_{i-1}+DX_{i-1})/8<X_IN$, (B)

$$AX_i=(AX_{i-1}+3BX_{i-1}+3CX_{i-1}+DX_{i-1})/8, \quad (2b')$$

$$BX_i=(BX_{i-1}+2CX_{i-1}+DX_{i-1})/4, \quad (3b')$$

$$CX_i=(CX_{i-1}+DX_{i-1})/2, \quad (4b')$$

$$DX_i=DX_{i-1}, \quad (5b')$$

$$AX_i=(AX_{i-1}+3BX_{i-1}+3CX_{i-1}+DX_{i-1})/8, \quad (6b')$$

$$BY_i=(BY_{i-1}+2CY_{i-1}+DY_{i-1})/4, \quad (7b')$$

$$CY_i=(CY_{i-1}+DY_{i-1})/2, \text{ and} \quad (8b')$$

$$DY_i=DY_{i-1} \quad (9b')$$

It would be apparent to a person skilled in the art that the equal sign may be attached to any one of the inequality signs recited in conditions (A) and (B).

Each midpoint calculation makes the control points $A_i$, $B_i$, $C_i$ and $D_i$ closer to the third degree Bezier curve, and also makes the X coordinate values of the control points $A_i$, $B_i$, $C_i$ and $D_i$ closer to the input grayscale value X_IN. The output value Y_OUT to be finally calculated is obtained from the Y coordinate of at least one of the control points $A_N$, $B_N$, $C_N$ and $D_N$ obtained by the N-th midpoint calculation. For example, the output value Y_OUT may be determined as the Y coordinate of an arbitrarily-selected one of the control points $A_N$, $B_N$, $C_N$ and $D_N$. Alternatively, the output value Y_OUT may be determined as the average value of the Y coordinates of the control points $A_N$, $B_N$, $C_N$ and $D_N$.

In a range in which the number of times N of the midpoint calculations is relatively small, the preciseness of the output value Y_OUT is more improved as the number of times N of the midpoint calculations is increased. It should be noted however that, once the number of times N of the midpoint calculations reaches the number of bits of the output value Y_OUT, the preciseness of the voltage data value Y_OUT is not further improved thereafter. In one embodiment, the number of times N of the midpoint calculations may be equal to the number of bits of the voltage data value Y_OUT. In the present embodiment, in which the output value Y_OUT is a 12-bit data, the number of times N of the midpoint calculations may be 12.

Further when the output value Y_OUT is calculated by using an $(n+1)^{th}$ order Bezier curve, the midpoint calculation may be performed after performing parallel displacement on the control points so that one of the control points is shifted to the origin O, similarly to the case where the second-order Bezier curve is used. When the gamma curve is expressed by a third degree Bezier curve, for example, the first to n-th order midpoints are calculated after subjecting the control points to parallel displacement so that the control point $B_{i-1}$ or $C_{i-1}$ is shifted to the origin O. Furthermore, either a combination of the control point $A_{i-1}'$ obtained by the parallel displacement, the first order minimum midpoint, the second order minimum midpoint and the third order midpoint or a combination of the third order midpoint, the second order maximum midpoint, the first order maximum midpoint, and the control point $D_{-1}'$ are selected as the next control points $A_i$, $B_i$, $C_i$ and $D_i$. Also in this case, the number of bits of values processed by each calculating unit is effectively reduced.

Although embodiments of the present disclosure have been specifically described in the above, it would be understood by a person skilled in the art that the technologies of the present disclosure may be implemented with various modifications.

What is claimed is:

1. A display driver, comprising:

correction circuitry configured to:

calculate a brightness data which specifies a screen brightness level of a self-luminous display panel;

determine correction control points by multiplying a ratio of the screen brightness level specified by the brightness data to an allowed maximum screen brightness of the self-luminous display panel with X coordinates of selected control points, wherein the correction control points are used for correction performed on an input grayscale value for the screen brightness level specified by the brightness data, and calculate an output value from the input grayscale value with input-output characteristics specified by the correction control points; and drive circuitry configured to:

generate a drive signal in response to the output value; and output the drive signal onto a light-emitting element of the self-luminous display panel.

2. The display driver according to claim 1, wherein the correction circuitry comprises:

specific-brightness-level control point data storage circuitry configured to store specific-brightness-level control point data specifying input-output characteristics between the input grayscale value and the output value for a case where the screen brightness level is a specific brightness level;

correction control point calculation circuitry configured to determine the correction control points based on the brightness data, the input grayscale value and the specific-brightness-level control point data; and correction calculation circuitry configured to calculate the output value from the input grayscale value with the input-output characteristics specified by the correction control points.

3. The display driver according to claim 2, wherein the specific-brightness-level control point data describe, with respect to a coordinate system defined with a first coordinate axis representing the input grayscale value and a second coordinate axis representing the output value, first coordinates specifying positions of specific-brightness-level control points in a direction along the first coordinate axis, and second coordinates specifying positions of the specific-brightness-level control points in a direction along the second coordinate axis.

4. The display driver according to claim 3, wherein the correction control point calculation circuitry is further configured to:

calculate, based on the brightness data and the first coordinates of the specific-brightness-level control points, third coordinates specifying positions of the correction control points in the direction along the first coordinate axis; and determine, based on the second coordinates of the specific-brightness-level control points, fourth coordinates specifying positions of the correction control points in the direction along the second coordinate axis.

5. The display driver according to claim 4, wherein the correction control point calculation circuitry is further configured to:

select the selected control points from among the specific-brightness-level control points based on the brightness data and the input grayscale value;

calculate the third coordinates of the correction control points based on the brightness data and the first coordinates of the selected control points; and determine the fourth coordinates of the correction control points as coinciding with the second coordinates of the selected control points.

6. The display driver according to claim 5, wherein the number of the correction control points determined by the correction control point calculation circuitry is n+1, n being an integer of two or more, and wherein a curve of the input-output characteristics specified by the correction control points is an nth order Bezier curve defined with the correction control points.

7. The display driver according to claim 5, wherein the correction control point calculation circuitry is further configured to calculate the third coordinates of the correction control points as products obtained by multiplying the first coordinates of the selected control points by a predetermined coefficient A, and wherein the coefficient A is determined in accordance with the following expression:

$$A=1/q(1/\gamma),$$

where q is the ratio of the screen brightness level specified by the brightness data to the allowed maximum brightness level and γ is a gamma value set with respect to the self-luminous display panel.

8. The display driver according to claim 7, wherein the specific-brightness-level control points include first to (p×n+1)th control points, p being an integer of two or more, wherein a first coordinate of an ith control point of the first to (p×n+1)th control points is larger than a first coordinate of an (i−1)th control point of the first to (p×n+1)th control points, i being an integer from one to p×n, wherein a first coordinate of the first control point is an allowed minimum value of the input grayscale value, wherein a first coordinate of the (p×n+1)th control point is an allowed maximum value of the input grayscale value, and wherein the correction control point calculation circuitry is configured to select ((k−1)×n+1)th to (k×n+1)th control points as the selected control points when a value obtained by multiplying the input grayscale value by an inverse number 1/A of the coefficient A is larger than the first coordinate of the ((k−1)×n+1)th control point and smaller than the first coordinate of the (k×n+1)th control point.

9. The display driver according to claim 6, wherein n is two.

10. A display device, comprising:

a self-luminous display panel in which each pixel circuit includes a light-emitting element; and a display driver configured to drive the self-luminous display panel, the display driver comprising:

correction circuitry configured to:

calculate a brightness data which specifies a screen brightness level of a self-luminous display panel;

determine correction control points by multiplying a ratio of the screen brightness level specified by the brightness data to an allowed maximum screen brightness of the self-luminous display panel with X coordinates of selected control points, wherein the correction control points are used for correction performed on an input grayscale value for the screen brightness level specified by the brightness data, and calculate an output value from the input grayscale value with input-output characteristics specified by the correction control points; and a drive circuitry configured to:

generate a drive signal in response to the output value; and output the drive signal onto a light-emitting element of the self-luminous display panel.

11. The display device according to claim 10, wherein the correction circuitry comprises:

specific-brightness-level control point data storage circuitry configured to: store specific-brightness-level control point data specifying input-output characteristics between the input grayscale value and the output value for a case where the screen brightness level is a specific brightness level;

correction control point calculation circuitry configured to: determine the correction control points based on the brightness data, the input grayscale value and the specific-brightness-level control point data; and correction calculation circuitry configured to: calculate the output value from the input grayscale value with input-output characteristics specified by the correction control points.

12. The display device according to claim 11, wherein the specific-brightness-level control point data describe, with respect to a coordinate system defined with a first coordinate axis representing the input grayscale value and a second coordinate axis representing the output value, first coordinates specifying positions of specific-brightness-level control points in a direction along the first coordinate axis and second coordinates specifying positions of the specific-brightness-level control points in a direction along the second coordinate axis.

13. The display device according to claim 12, wherein the correction control point calculation circuitry is further configured to:

calculate, based on the brightness data and the first coordinates of the specific-brightness-level control points, third coordinates specifying positions of the correction control points in the direction along the first coordinate axis; and determine, based on the second coordinates of the specific-brightness-level control points, fourth coordinates specifying positions of the correction control points in the direction along the second coordinate axis.

14. The display device according to claim 13, wherein the correction control point calculation circuitry is further configured to:

select the selected control points from among the specific-brightness-level control points based on the brightness data and the input grayscale value;

calculate the third coordinates of the correction control points based on the brightness data and the first coordinates of the selected control points; and determine the fourth coordinates of the correction control points as coinciding with the second coordinates of the selected control points.

15. The display device according to claim 14, wherein the number of the correction control points determined by the correction control point calculation circuitry is n+1, n being an integer of two or more, and wherein a curve of the input-output characteristics specified by the correction control points is an nth order Bezier curve defined with the correction control points.

16. The display device according to claim 14, wherein the correction control point calculation circuitry is configured to calculate the third coordinates of the correction control points as products obtained by multiplying the first coordinates of the selected control points by a predetermined coefficient A, and wherein the coefficient A is determined in accordance with the following expression:

$$A=1/q(1/\gamma),$$

where q is the ratio of the screen brightness level specified by the brightness data to the allowed maximum brightness level and γ is a gamma value set with respect to the self-luminous display panel.

17. A method, comprising:

calculating a brightness data which specifies a screen brightness level of a self-luminous display panel;

determining correction control points by multiplying a ratio of the screen brightness level specified by the brightness data to an allowed maximum screen brightness of the self-luminous display panel with X coordinates of selected control points, wherein the correction control points are used for correction performed on an input grayscale value for the screen brightness level specified by the brightness data, and calculating an output value from the input grayscale value with input-output characteristics specified by the correction control points; and generating a drive signal in response to the output value; and outputting the drive signal onto a light-emitting element of the self-luminous display panel.

18. The method according to claim 17, wherein the determining the correction control points comprises:

providing specific-brightness-level control point data specifying input-output characteristics between the input grayscale value and the output value for a case where the screen brightness level is a specific brightness level; and determining the correction control points based on the brightness data, the input grayscale value and the specific-brightness-level control point data.

19. The method according to claim 18, wherein the specific-brightness-level control point data describe, with respect to a coordinate system defined with a first coordinate axis representing the input grayscale value and a second coordinate axis representing the output value, first coordinates specifying positions of specific-brightness-level control points in a direction along the first coordinate axis and second coordinates specifying positions of the specific-brightness-level control points in a direction along the second coordinate axis.

20. The method according to claim 19, wherein the determining the correction control points comprises:

calculating, based on the brightness data and the first coordinates of the specific-brightness-level control points, third coordinates specifying positions of the correction control points in the direction along the first coordinate axis; and determining, based on the second coordinates of the specific-brightness-level control points, fourth coordinates specifying positions of the correction control points in the direction along the second coordinate axis.

* * * * *